US005447818A

United States Patent [19]

Naruse et al.

[11] Patent Number: 5,447,818

[45] Date of Patent: Sep. 5, 1995

[54] COLOR DIFFUSION TRANSFER FILM UNIT

[75] Inventors: Hideaki Naruse; Hideki Naito; Jiro Tsukahara; Tomokazu Yasuda, all of Kanagawa, Japan

[73] Assignee: Fuji Photo Film Co, Ltd., Kanagawa, Japan

[21] Appl. No.: 333,313

[22] Filed: Nov. 1, 1994

[30] Foreign Application Priority Data

| | | | |
|---|---|---|---|
| Nov. 2, 1993 | [JP] | Japan | 5-274636 |
| Nov. 2, 1993 | [JP] | Japan | 5-296017 |
| Feb. 23, 1994 | [JP] | Japan | 6-047984 |

[51] Int. Cl.[6] ..... G03C 8/38; G03C 8/56

[52] U.S. Cl. ..... 430/214; 430/213; 430/216; 430/218; 430/236; 430/239; 430/941; 430/466

[58] Field of Search ..... 430/213, 214, 215, 216, 430/466, 218, 941

[56] References Cited

U.S. PATENT DOCUMENTS

| | | | |
|---|---|---|---|
| 3,600,171 | 8/1971 | Cole | 430/218 |
| 3,679,409 | 7/1972 | Buckley et al. | 430/214 |
| 3,928,312 | 12/1975 | Fleckenstein | 260/156 |
| 3,930,864 | 1/1976 | Abel et al. | 430/213 |
| 4,069,048 | 1/1978 | Tsubota et al. | 430/214 |
| 4,358,532 | 11/1982 | Koyama et al. | 430/223 |
| 4,378,919 | 2/1983 | Toriuchi | 430/212 |
| 4,474,854 | 10/1984 | Bergthaller et al. | 430/214 |
| 4,590,154 | 5/1986 | Hirai et al. | 430/218 |
| 4,741,980 | 5/1988 | Kaneko | 430/216 |
| 5,112,720 | 5/1992 | Karino | 430/214 |
| 5,194,361 | 3/1993 | Taguchi | 430/214 |

FOREIGN PATENT DOCUMENTS

| | | | |
|---|---|---|---|
| 50-142233 | 11/1975 | Japan | G03C 7/00 |
| 602654 | 1/1985 | Japan | G03C 7/00 |
| 353248 | 3/1991 | Japan | G03C 8/42 |
| 1537079 | 4/1976 | United Kingdom | G03C 5/54 |

*Primary Examiner*—Richard L. Schilling
*Attorney, Agent, or Firm*—Sughrue, Mion, Zinn, Macpeak & Seas

[57] ABSTRACT

A color diffusion transfer film unit and an image formation method using the same are disclosed, in which a light-sensitive material containing a specific sulfonamide compound of formula (I) and a specific tertiary amine compound of formula (II) is processed with an alkali processing composition containing a specific tertiary amine polymer. The film provides a transferred color image having a high density with reduced dependency on processing time, and suppresses changes in density of the resulting image with time after processing.

11 Claims, No Drawings

COLOR DIFFUSION TRANSFER FILM UNIT

FIELD OF THE INVENTION

This invention relates to a color diffusion transfer film unit and more particularly to a color diffusion transfer film unit which provides an image having improved density and prevents an increase in density with time after image formation.

BACKGROUND OF THE INVENTION

A diffusion transfer film unit consists essentially of an image-generating layer (or a light-sensitive layer), a dye-receiving layer (or an image-receiving layer), and a processing solution, as described, e.g., U.S. Pat. No. 3,928,312. The image-generating layer contains a light-sensitive silver halide emulsion and releases a diffusing dye in proportion to an exposure. The dye-receiving layer has a function of fixing the dye generated in the image-generating layer. The processing solution contains at least a substance necessary for development, such as an alkali or a reducing agent.

Known diffusion transfer light-sensitive materials are roughly divided into a peel-apart type and a monosheet type (non-peel type).

The peel-apart type film unit has a light-sensitive layer and a dye-receiving layer on separate supports. After imagewise exposure, the light-sensitive element and the image-receiving element are brought into contact, a processing solution is spread therebetween, and the dye image-receiving element is peeled off to obtain a dye image transferred on the dye image-receiving layer. The peel-apart type film unit is disadvantageous in that the dye contained in the light-sensitive element would further be transferred to the dye image-receiving layer to disturb the color balance or to stain the white background unless the dye image-receiving element is peeled within a prescribed time.

The monosheet type film units comprise a pair of substrates one of which is transparent, in between which a dye image-receiving layer and a silver halide emulsion layer are provided. The dye-image receiving layer and the silver halide emulsion layer may be provided on the same transparent support or separate supports. In the former case, a white reflecting layer is provided between the image-receiving layer and the silver halide emulsion layer, and in the latter case a processing solution to be spread between the image-receiving layer and the silver halide emulsion layer contains a white pigment, so that the dye image transferred to the image-receiving layer may be seen by reflected light.

The monosheet type film units are disadvantageous in that it takes time for the dye released from the silver halide emulsion layer to be transferred to the image-receiving layer and be fixed thereon completely. It follows that the image undergoes great change in density with time after processing.

The above-mentioned problems either of the peel-apart type or the monosheet type tend to become conspicuous with an increasing amount of a dye generated. From this viewpoint, it has been demanded to establish a dye transfer technique by which a high transfer density can be obtained, processing time dependency is reduced, and change in density with time after processing is suppressed.

Retarded dye transfer causing various disadvantages as stated above should be minimized for improvement of image quality. To this effect, it has been proposed to provide a dye-trapping layer in a film unit as disclosed in British Patent 1537079, JP-B-60-2654, JP-A-50-142233, and JP-A-3-53248 (the terms "JP-A" and "JP-B" as used herein mean an unexamined published Japanese patent application and an examined published Japanese patent application, respectively). Although a dye-trapping layer is effective to capture the residual dye to suppress retarded dye transfer, it deteriorates green preservability of the film unit.

On the other hand, U.S. Pat. No. 3,928,312 discloses a color diffusion transfer process using an azo dye-forming substance which, upon being developed under a basic condition, releases an azo dye having different diffusibility from the image-forming dye. However, the azo dye-forming substance proposed does not always attain a high dye release efficiency, failing to obtain a sufficient transfer density.

Countermeasures against the above problem include the method described in JP-B-4-13701, but the method achieves no improving effects. In addition, the substances used in this method are accompanied by reduction in image stability.

As described above, a diffusion transfer process involves several problems attributed to the use of diffusing dyes, though superior in simpleness and rapidness in obtaining a photographic image.

The most serious of these problems is retarded dye transfer. In order to finish image formation within a reasonably short time, an image-generating layer must generate a dye in excess over the amount of the dye to be fixed on a dye-receiving layer. As a result, even at the time when transfer of a desired image is completed, an excess dye remains in a layer other than the dye-receiving layer. Retarded dye transfer is a phenomenon that the residual dye is gradually transferred to the dye-receiving layer and fixed thereon.

Retarded transfer in a monochromatic dye (for example, a black dye) transfer diffusion process makes the image harder than necessary, tending to lose the shadow gradation (i.e., plugging). Retarded transfer in a color diffusion transfer process based on a subtractive color process causes not only black plugging but disturbance of color balance because three kinds of dyes (for example, a yellow dye, a magenta dye and a cyan dye) are usually different in diffusibility and therefore different in requisite excess to be generated.

Further, the residual dye transferred to the image-receiving layer also diffuses to the planar direction to reduce the image sharpness.

SUMMARY OF THE INVENTION

An object of the present invention is to provide a color diffusion transfer film unit which provides a high transfer density, has reduced dependency on processing time, and undergoes little change in density with time after processing.

Another object of the present invention is to provide a method for forming an image of high transfer density using a color diffusion transfer film unit while reducing dependency on processing time and suppressing change in density with time after processing.

The above objects of the present invention are accomplished by the following color diffusion transfer film units:

A color diffusion transfer film unit consisting of (1) a light-sensitive sheet comprising a transparent support having thereon an image-receiving layer, a white reflecting layer, a light-shielding layer, and at least one silver halide emulsion layer combined with at least one dye image-forming compound, (2) a transparent cover sheet comprising a transparent support having thereon at least a neutralizing layer and a neutralization timing layer, and (3) a light-shielding alkali processing composition which is to be spread between light-sensitive sheet (1) and cover sheet (2), in which the alkali processing composition contains a tertiary amine polymer.

A color diffusion transfer film unit consisting of (1) an image-receiving sheet comprising a support having thereon a neutralizing layer, a neutralization timing layer, an image-receiving layer, and a release layer in this order, (2) a light-sensitive sheet comprising a light-shielding support having thereon at least one silver halide emulsion layer combined with at least one dye image-forming compound, and (3) an alkali processing composition which is to be spread between image-receiving sheet (1) and light-sensitive sheet (2), in which the alkali processing composition contains a tertiary amine polymer.

A color diffusion transfer film unit consisting of (1) a light-sensitive sheet comprising a transparent support having thereon an image-receiving layer, a white reflecting layer, a light-shielding layer and at least one silver halide emulsion layer combined with at least one dye image-forming compound, (2) a transparent cover sheet comprising a transparent support having thereon at least a neutralizing layer and a neutralization timing layer, and (3) a light-shielding alkali processing composition which is to be spread between light-sensitive sheet (1) and cover sheet (2), in which the film unit contains at least one compound represented by formula (I):

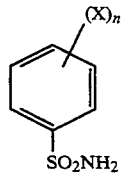

(I)

wherein X represents a hydrogen atom, a halogen atom, an alkyl group, a cycloalkyl group, an aralkyl group, an alkenyl group, an aryl group, an alkoxy group, an aryloxy group, an acylamino group, a sulfonylamino group, a ureido group, an alkylthio group, an arylthio group, an alkoxycarbonyl group, a carbamoyl group, a sulfamoyl group, an acyl group, a sulfonyl group, a urethane group, an amino group, a sulfamoylamino group, a heterocyclic group, a hydroxyl group, or a phosphonic ester group; and n represents an integer of from 1 to 5; when n is 2 or more, two X's may be taken together with the benzene ring to form a ring, and at least one compound selected from the group consisting of a compound represented by formula (II) and a polymer having repeating unit represented by formula (III):

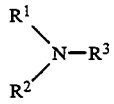

(II)

wherein $R^1$ and $R^2$ each independently represent a hydrogen atom, an aliphatic group or an aryl group; and $R^3$ represents an aliphatic group or a group represented by formula (Ab):

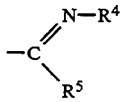

(Ab)

wherein $R^4$ represents a hydrogen atom, an aliphatic group or an aryl group; and $R^5$ represents an aliphatic group, an aryl group or an amino group; $R^1$ and $R^2$, $R^1$ and $R^3$, $R^2$ and $R^3$, or $R^4$ and $R^5$ may be connected to each other to form a ring; $R^1$, $R^2$ and $R^3$ may be connected one another to form a bicyclic ring; the total carbon atom number in $R^1$, $R^2$ and $R^3$ is at least 10; at least one of $R^1$ and $R^2$ is an aliphatic group; when the other one of $R^1$ and $R^2$ is an aryl group, $R^3$ is the group of formula (Ab).

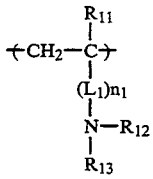

(III)

wherein $R_{11}$ represents a hydrogen atom or an alkyl group having 1 to 4 carbon atoms; $R_{12}$ and $R_{13}$ each independently represent an alkyl group having 1 to 20 carbon atoms, an aralkyl group, an alkenyl group or an alkynyl group; $L_1$ represents a divalent linking group having 1 to 24 carbon atoms; $R_{12}$, $R_{13}$, and $L_1$ may be taken together to form a nitrogen-containing 3- to 8-membered ring; and n1 represents 0 or 1.

A color diffusion transfer film unit consisting of (1) an image-receiving sheet comprising a support having thereon a neutralizing layer, a neutralization timing layer, an image-receiving layer, and a release layer in this order, (2) a light-sensitive sheet comprising a light-shielding support having thereon at least one silver halide emulsion layer combined with at least one dye image-forming compound, and (3) an alkali processing composition which is to be spread between image-receiving sheet (1) and light-sensitive sheet (2), in which the film unit contains at least one compound represented by formula (I) and at least one compound selected from the group consisting of a compound represented by formula (II) and a polymer having a repeating unit represented by formula (III).

An image formation method for a color diffusion transfer process, comprising using a peel-apart type or monosheet type color diffusion transfer film unit containing an alkali processing composition containing a tertiary amine polymer.

An image formation method for a color diffusion transfer process, comprising using a peel-apart type or monosheet type color diffusion transfer film unit containing at least one compound represented by formula (I) and at least one compound selected from the group consisting of a compound represented by formula (II) and a polymer having a repeating unit represented by formula (III).

DETAILED DESCRIPTION OF THE INVENTION

In formulae (I) to (III), X represents a hydrogen atom, halogen atom (e.g., chlorine or bromine), an alkyl group (preferably having 1 to 30 carbon atoms, e.g., methyl, t-octyl, dodecyl, 2-hexyldecyl or methoxydecyl), a cycloalkyl group (e.g., cyclopentyl or cyclohexyl), an aralkyl group (e.g., benzyl or 2-phenethyl), an alkenyl (e.g., vinyl, allyl or crotyl), an aryl group (e.g., phenyl, naphthyl, 4-octyloxyphenyl or 3-hexadecylphenyl), an alkoxy group (preferably having 1 to 30 carbon atoms, e.g., methoxy, 2-ethylhexyloxy or 2-dodecyloxyethoxy), an aryloxy group (e.g., phenoxy or 4-t-octylphenoxy), an acylamino group (e.g., acetamido, N-ethyldodecanamido, 2-n-heptylundecanamido, 4-t-butylbenzamido or 2-(2,4-di-t-amylphenoxy)butanamido), a sulfonylamino group (e.g., ethanesulfonamido, 2-octyloxy-5-t-octylbenzenesulfonamido or hexadecylsuccinamido), a ureido group (e.g., 3-hexadecylureido or 3,3-dioctylureido), an alkylthio group (ethylthio or dodecylthio), an arylthio group (e.g., phenylthio or 4-ethoxyphenylthio), an alkoxycarbonyl group (e.g., ethoxycarbonyl, hexadecyloxycarbonyl or 2-hexyldecyloxycarbonyl), a carbamoyl group (e.g., dimethylcarbamoyl , 3-phenoxypropylcarbamoyl or dioctylcarbamoyl), a sulfamoyl group (e.g., dimethylsulfamoyl, morpholinosulfamoyl, dioctylsulfamoyl or hexadecylsulfamoyl), an acyl group (e.g., propionyl or benzoyl), a sulfonyl group (e.g., methanesulfonyl or dodecylsulfonyl), a urethane group (e.g., hexadecylurethane or 2-hexyldecylurethane), an amino group (e.g., dioctylamino, N-ethyl-N-dodecylamino or 4-methoxyanilino), a sulfamoylamino group (e.g., 3,3-dioctylaminosulfamoyl or butylaminosulfamoyl), a heterocyclic group (e.g., α-pyridyl or 2-furfuryl), a hydroxyl group, or a phosphonic ester group (e.g., dicyclohexylphosphonate or di-n-octylphosphonate).

When n is 2 or greater, two X's may form a saturated or unsaturated ring together with the benzene ring. Examples of the ring include a 5,6,7,8-tetrahydronaphthalene ring, a naphthalene ring, an anthracene ring, an indane ring, an indene ring, an acenaphthene ring, a quinoline ring, a benzothiophene ring, an isobenzofuran ring, an indole ring, a 3H-indole ring, an indazole ring, a coumarone ring, an indoline ring, a benzothiazole ring, a benzimidazole ring, a benzoxazole ring, and a benzotriazole ring, each of which may have a substituent(s) selected from the groups recited above as X.

The compound of formula (I) is preferably a nondiffusion compound. The term "nondiffusion compound" means a compound containing a non-diffusing group having a sufficiently large molecular weight enough to immobilize the compound in a layer where it is added. An alkyl group having 8 to 30 carbon atoms, preferably 10 to 22 carbon atoms, in total or an aryl group having 4 to 20 carbon atoms in total is usually used as such a non-diffusing group. The nondiffusion compound may contain two or more of these non-diffusing groups.

The compound of formula (I) may form a dimer or an oligomer by linking at the group represented by X via a divalent or polyvalent linking group.

Of the above-enumerated groups as X preferred are an alkyl group having 10 to 22 carbon atoms, an alkoxy group having 10 to 22 carbon atoms, an alkoxycarbonyl group having 10 to 30 carbon atoms, an acylamino group having 10 to 30 carbon atoms, and a urethane group having 10 to 30 carbon atoms, with the acylamino or urethane group being still preferred.

Specific but non-limiting examples of the compounds of formula (I) are shown below.

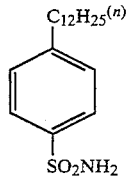

I-1

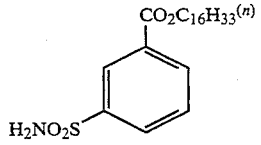

I-2

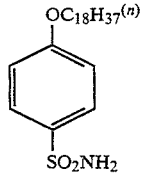

I-3

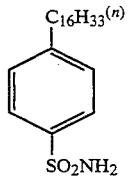

I-4

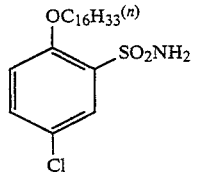

I-5

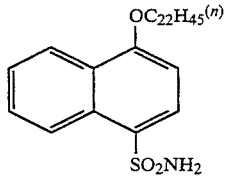

I-6

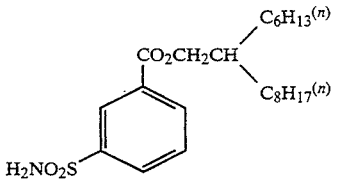

I-7

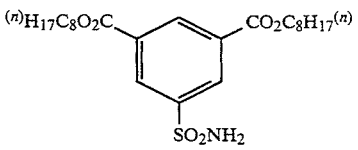

I-8

-continued
I-9
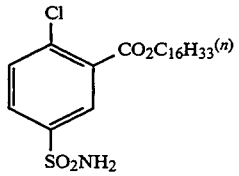
I-10
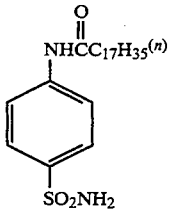
I-11
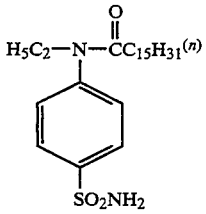
I-12
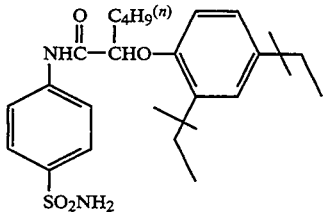
I-13
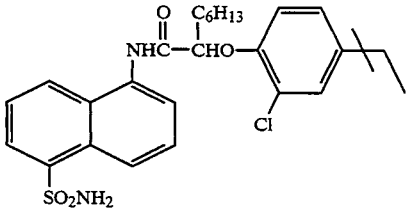
I-14
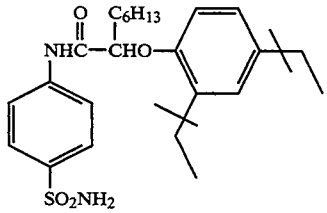
I-15
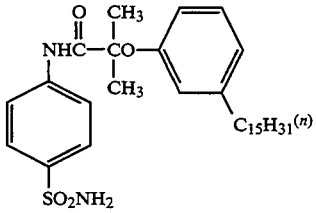
-continued
I-16
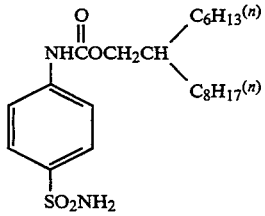
I-17
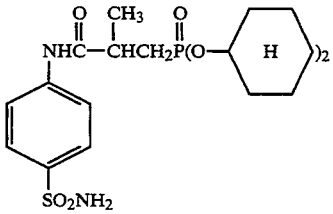
I-18
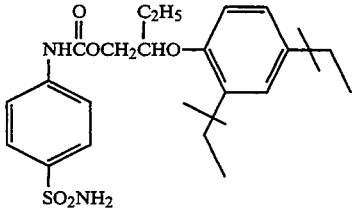
I-19
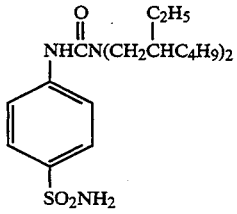
I-20
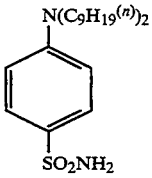
I-21
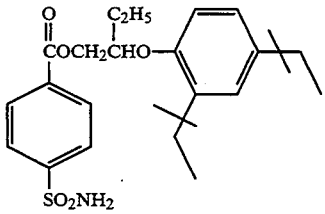
I-22
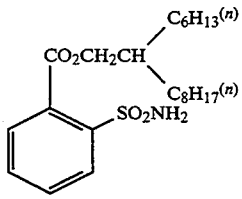

-continued
I-23
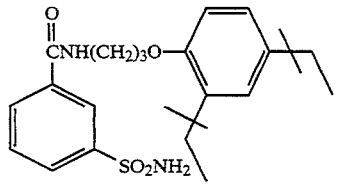
I-24
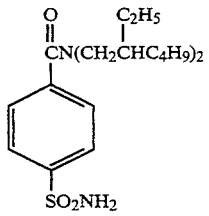
I-25
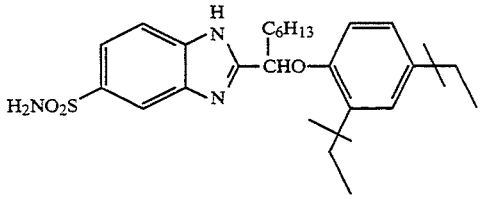
I-26
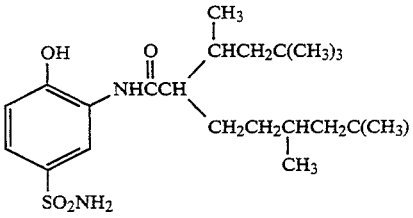
I-27
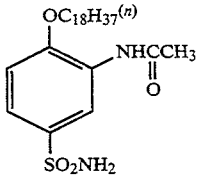
I-28
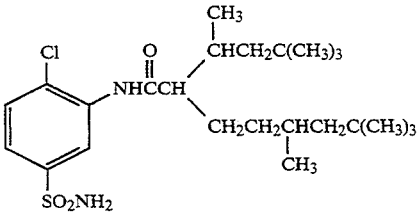
I-29
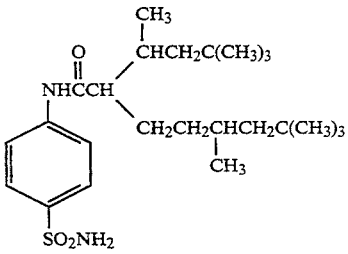
-continued
I-30
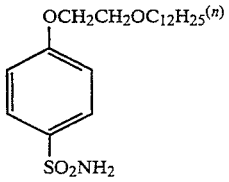
I-31
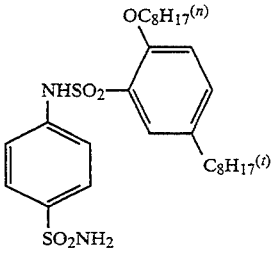
I-32
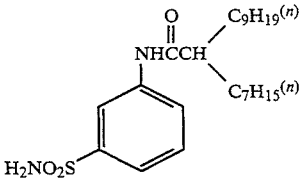
I-33
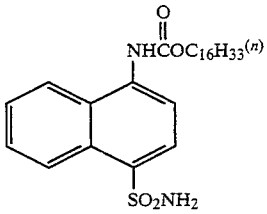
I-34
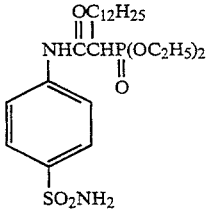
I-35
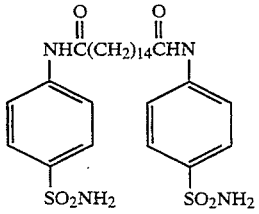
I-36
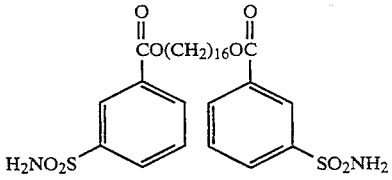

-continued

I-37

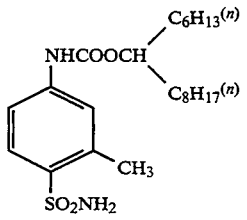

I-38

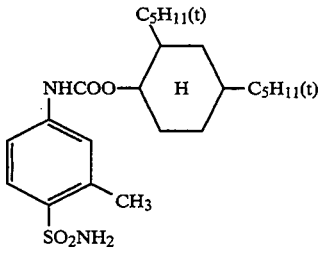

I-39

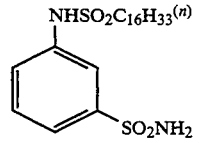

I-40

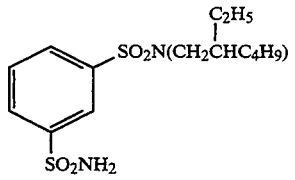

I-41

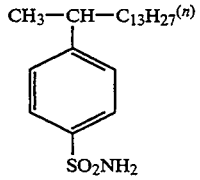

I-42

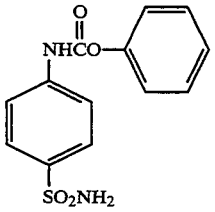

In the above compounds of formula (I), it is preferable that at least one of the ortho-positions (inclusive of the peri-positions of a naphthalene ring) with respect to the sulfamoyl group is a hydrogen atom.

Synthesis of the compounds of formula (I) are shown in the following Synthesis Examples.

SYNTHESIS EXAMPLE 1

Synthesis of Compound I-1

In 20 ml of chlorosulfonic acid was added dropwise 21 g of n-dodecylbenzene at 20° C. or lower under cooling with water over a period of 30 minutes. After the addition, the mixture was stirred for 2 hours and then poured into 300 g of ice-water while stirring.

The oily phase was separated and extracted with 300 ml of ethyl acetate. The aqueous layer was discarded, and the ethyl acetate extract was added dropwise to 1 l of a saturated solution of ammonia in acetonitrile at 0° C. or lower over 30 minutes while stirring. After the addition, the mixture was further stirred under ice-cooling for 1 hour and then at room temperature for 1 hour. The reaction mixture was extracted with ethyl acetate, and the extract was concentrated to dryness under reduced pressure. The precipitated crystals were purified by flash column chromatography on silica gel using chloroform as a solvent to yield 17 g (61%) of compound I-1. Melting point: 97°–98° C.

SYNTHESIS EXAMPLE 2

,Synthesis of Compound I-2

A hundred milliliters of N,N-dimethylacetamide was added dropwise to a suspension of 52.6 g of 3-chlorosulfonylbenzoyl chloride and 48 g of 1-hexadecanol in 500 ml of acetonitrile at room temperature over 15 minutes with stirring. After the addition, the stirring was further continued for an additional period of 2 hours. The precipitated crystals were collected by filtration and washed with 200 ml of acetonitrile to recover 68 g (78%) of the crystals.

A 60 g portion of the crystals was added in small portions to 1 l of a saturated ammonia solution in acetonitrile at 0° C. or lower over 30 minutes while stirring. After the addition, the stirring was continued for 2 hours. To the reaction mixture was added 1 l of water, and the thus precipitated crystals were collected by filtration, washed with water, and thoroughly dried. The crystals were dissolved in chloroform and subjected to flash chromatography (silica gel/chloroform) to obtain 44 g (57%) of compound I-2. Melting point: 81°–82° C.

SYNTHESIS EXAMPLE 3

Synthesis of Compound I-12

2-(2,4-Di-t-amylphenoxy)hexanoyl chloride (36.6 g) was added dropwise to a solution of 17.2 g of sulfanilamide and 10 ml of pyridine in 100 ml of N,N-dimethylacetamide at 5° C. or lower over about 30 minutes while stirring. After completion of the addition, the mixture was further stirred under ice-cooling for 1 hour and then under water-cooling for 1 hour. On addition of 300 ml of water to the reaction mixture, a viscous oily substance precipitated. The supernatant liquid was discarded by decantation, and the oily substance was dissolved in 200 ml of ethyl acetate and dried over anhydrous magnesium sulfate overnight. After removing magnesium sulfate by filtration, the solvent was removed by evaporation under reduced pressure, and the residue was dissolved in 100 ml of methanol. To the solution was added 30 ml of water at room temperature with stirring, and 0.1 g of seed crystals of compound I-12 was added thereto. The thus precipitated crystals were collected by filtration, washed with 100 ml of water, and thoroughly dried. Recrystallization from a mixed solvent of 300 ml of n-hexane and 50 ml of ethyl acetate gave 21 g (42%) of compound I-12. Melting point: 120° C.

SYNTHESIS EXAMPLE 4

Synthesis of Compound I-16

Forty-seven grams of phenyl chloroformate were added dropwise to a solution of 51.6 g of sulfanilamide and 30 ml of pyridine in 300 ml of N,N-dimethylacetamide over a period of 30 minutes with stirring while maintaining the inner temperature between 0° and 5° C. After completion of the addition, the mixture was further stirred at that temperature for 1 hour and then under ice-cooling for 1 hour. On addition of 600 ml of water, white crystals were precipitated. After stirring the mixture as containing the crystals for 1 hour, the crystals were collected by filtration, washed with water, and dried to recover 82 g (94%) of compound I-42.

A mixture of 20 g of compound I-42 and 83 g of fine oxocol 1600 was stirred at 150 to 160° C. for 2 hours and then at 200° to 220° C. for 6 hours. After allowing the reaction mixture to stand at room temperature overnight, 200 ml of n-hexane was added thereto. The precipitated crystals were collected by filtration and washed with 100 ml of n-hexane. Recrystallization of the crude crystals from a mixed solvent of 300 ml of n-hexane and 60 ml of ethyl acetate afforded 15 g (52%) of compound I-16. Melting point: 111°–112° C.

In formula (II), $R^1$ and $R^2$ each independently represent a hydrogen atom, an aliphatic group or an aryl group. The aliphatic group as $R^1$ and $R^2$ preferably includes a substituted or unsubstituted alkyl or alkenyl group having 1 to 40 carbon atoms, such as methyl, ethyl, isopropyl, t-butyl, dodecyl, 4-(2,4-di-t-pentylphenoxy)butyl, 3-(3-dodecyloxyphenylcarbmoyl)propyl, 2-hexyldecyl, cyclohexyl, 2phenethyl, benzyl, 3-dioctylaminopropyl, allyl or 8-octadecenyl. The aryl group preferably includes a substituted or unsubstituted phenyl group having 6 to 36 carbon atoms, such as phenyl, 4-dodecyloxyphenyl or 3-chlorophenyl.

$R^3$ represents an aliphatic group or a group represented by formula (Ab). The aliphatic group as $R^3$ preferably includes a substituted or unsubstituted alkyl or alkenyl group having 1 to 40 carbon atoms, such as methyl, ethyl, isopropyl, t-butyl, dodecyl, 4-(2,4-di-t-pentylphenoxy)butyl, 3-(3-dodecyloxyphenylcarbmoyl)propyl, 2-hexyldecyl, cyclohexyl, 2-phenethyl, benzyl, allyl or 8-octadecenyl.

In formula (Ab), $R^4$ represents a hydrogen atom, an aliphatic group or an aryl group. The aliphatic group preferably includes a substituted or unsubstituted alkyl or alkenyl group having 1 to 40 carbon atoms, such as methyl, ethyl, isopropyl, t-butyl, dodecyl, 4-(2,4-di-t-pentylphenoxy)butyl, 3-(3-dodecyloxyphenylcarbmoyl)propyl, 2-hexyldecyl, cyclohexyl, 2-phenethyl, benzyl, 3-dioctylaminopropyl, allyl or 8-octadecenyl. The aryl group preferably includes a substituted or unsubstituted phenyl group having 6 to 36 carbon atoms, e.g., phenyl, 4-dodecyloxyphenyl or 3-chlorophenyl.

$R^5$ represents an aliphatic group, an aryl group, or an amino group. The aliphatic group as $R^5$ preferably includes a substituted or unsubstituted alkyl or alkenyl group having 1 to 40 carbon atoms, such as methyl, ethyl, isopropyl, t-butyl, dodecyl, 4-(2,4-di-t-pentylphenoxy)butyl, 3-(3-dodecyloxyphenylcarbmoyl)propyl, 2-hexyldecyl, cyclohexyl, 2-phenethyl, benzyl, 3-dioctylaminopropyl, allyl or 8-octadecenyl. The aryl group preferably includes a substituted or unsubstituted phenyl group having 6 to 36 carbon atoms, e.g., phenyl, 4-dodecyloxyphenyl or 3-chlorophenyl. The amino group preferably includes a substituted amino group having 1 to 50 carbon atoms. Where the amino group is N,N-disubstituted, the two substituents on the nitrogen atom may be taken together to form a heterocyclic ring. Examples of the amino group are anilino, dioctylamino, N-ethylanilino, and piperidyl groups.

$R^1$ and $R^2$, $R^1$ and $R^3$, $R^2$ and $R^3$, or $R^4$ and $R^5$ may be connected to each other to form a 5- to 7-membered ring, e.g., a piperazine ring, a piperidine ring, a pyrrolidine ring or a homopiperazine ring. $R^1$, $R^2$ and $R^3$ may be connected one another to form a bicyclic ring, such as a bicyclo[2,2,2]octane ring. The total carbon atom number in $R^1$, $R^2$ and $R^3$ is at least 10, and at least one of $R^1$ and $R^2$ is an aliphatic group. When the other is an aryl group, $R^3$ is the group of formula (Ab).

From the standpoint of effects produced, it is preferable that $R^1$ and $R^2$ each represent an aliphatic group; that the total carbon atom number in $R^1$, $R^2$ and $R^3$ is 18 or greater and still preferably from 20 to 80; and that the substituent, if any, on the aliphatic group as $R^1$, $R^2$, $R^3$, $R^4$ and $R^5$ is selected from a carbamoyl group, an alkoxy group, an aryloxy group, an aryl group, a sulfonyl group, an acylamino group, an alkylamino group, and a heterocyclic group.

Specific but non-limiting examples of the compounds of formula (II) are shown below.

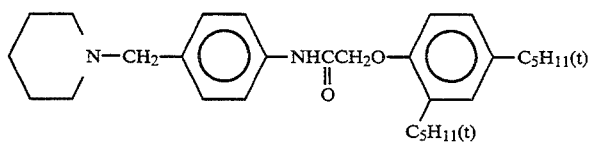

II-1

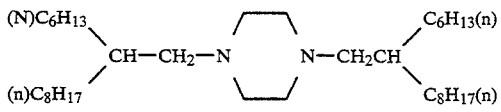

II-2

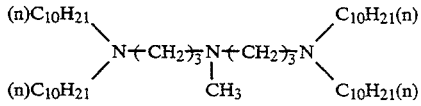

II-3

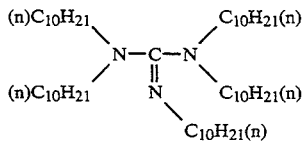

II-4

-continued
$((n)C_8H_{17})_3N$ II-5
II-6
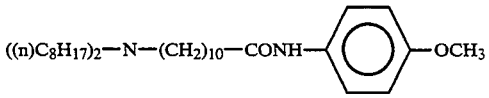
II-7
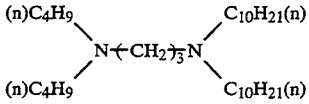
II-8
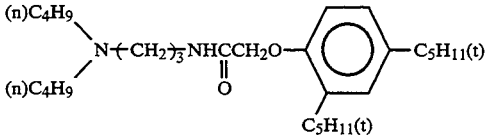
II-9
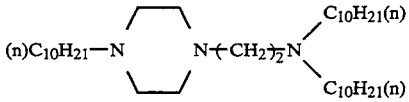
II-10
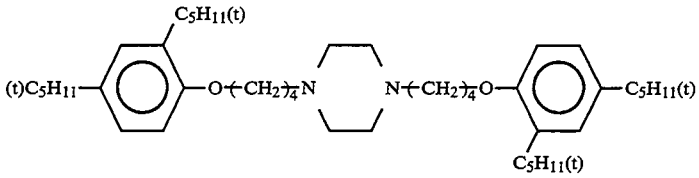
II-11
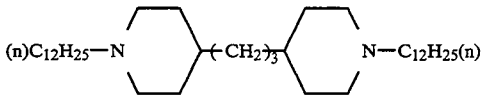
II-12
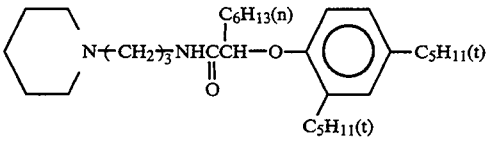
II-13
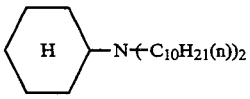
II-14
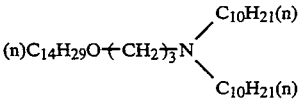
II-15
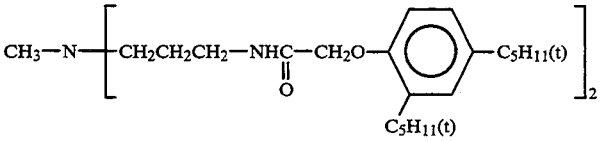
II-16
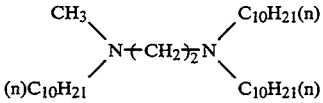
II-17
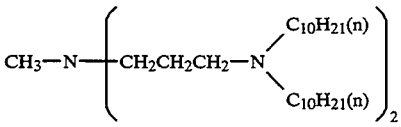

-continued
II-18
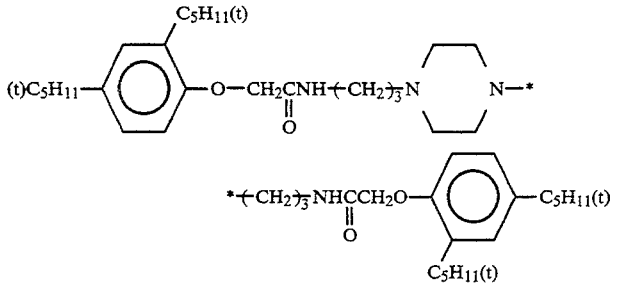
II-19
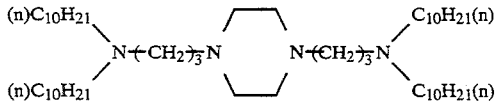
II-20
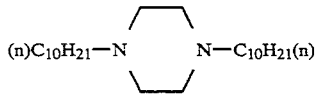
II-21
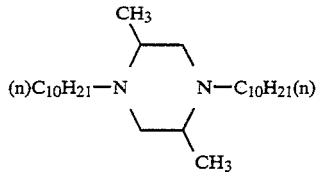
II-22
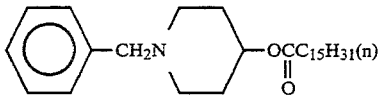
II-23
$(CH_3(CH_2)_7CH{=}CH(CH_2)_8)_2N{-}C_{18}H_{37}$
II-24
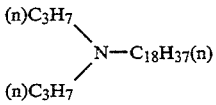
II-25
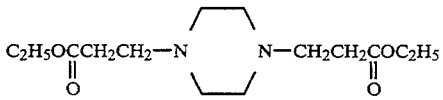
II-26
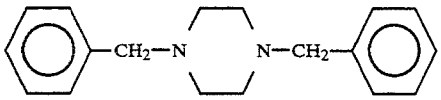
II-27
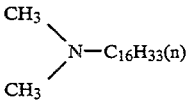
II-28
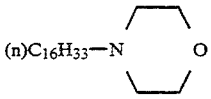
II-29
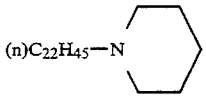

-continued
II-30
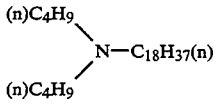
II-31
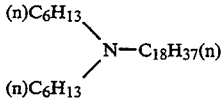
II-32
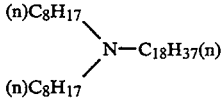
II-33
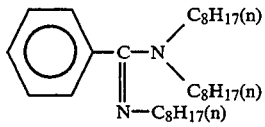
II-34
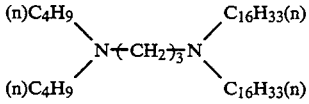
II-35
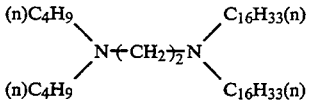
II-36
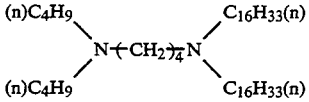
II-37
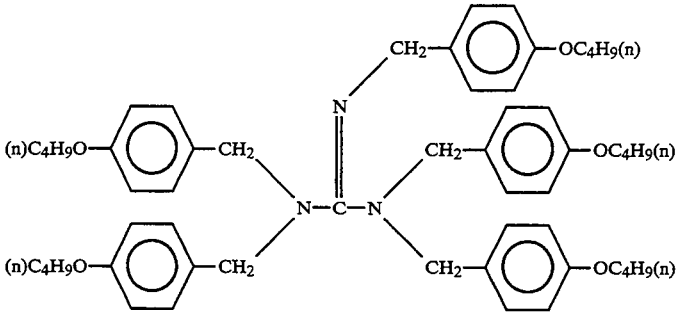
II-38
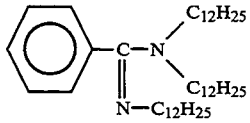
II-39
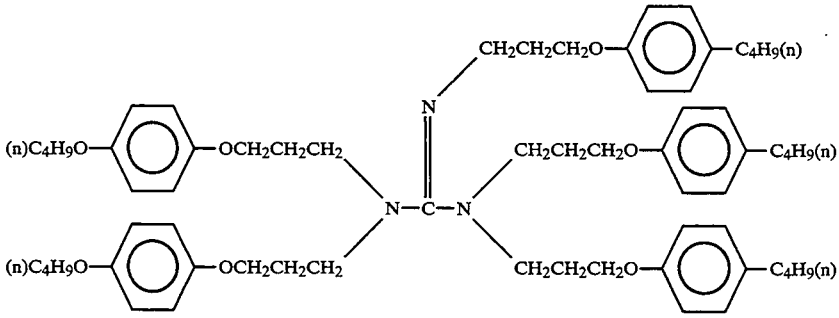

-continued
II-40
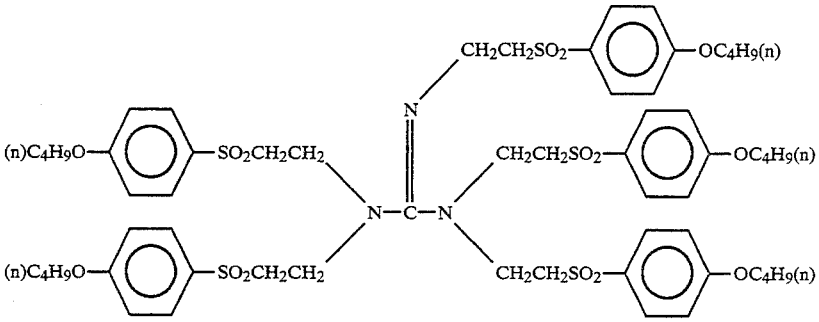
II-41
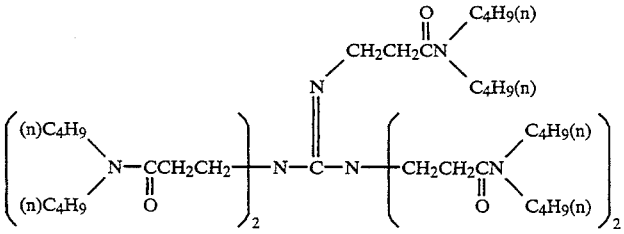
II-42
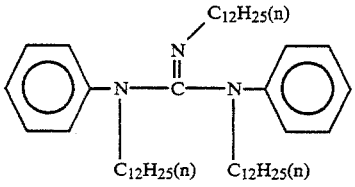
II-43
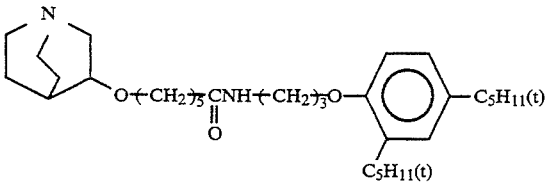
II-44
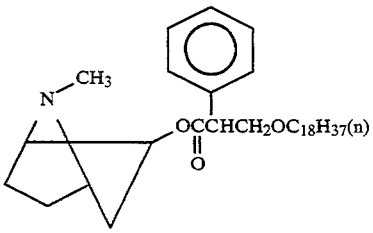
II-45
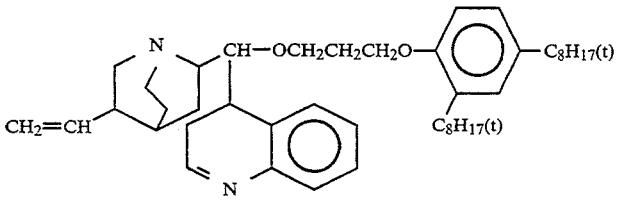

-continued
II-46
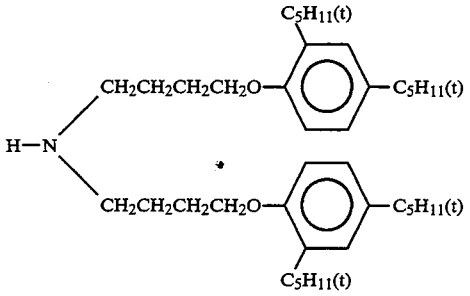
II-47
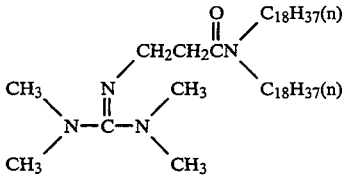
II-48
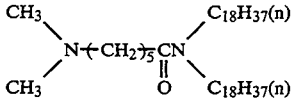
II-49
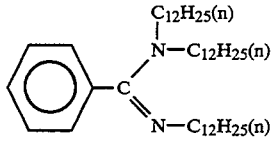
II-50
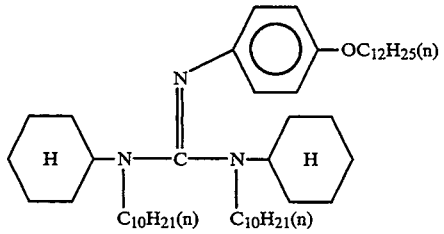
II-51
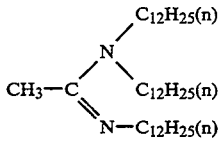
II-52
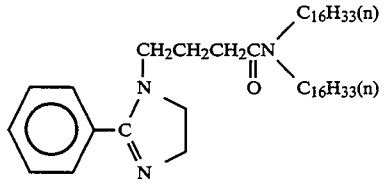
II-53
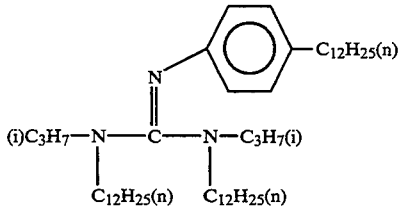

-continued

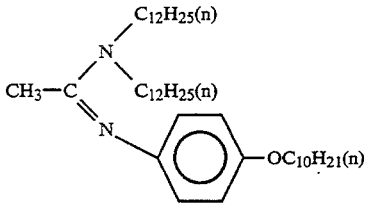

II-54

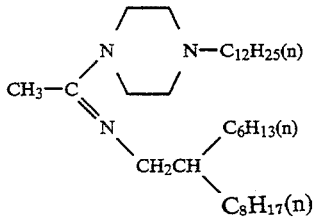

II-55

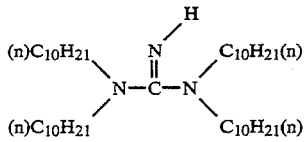

II-56

The compounds of formula (II) can be synthesized by the reaction between a primary or secondary amine and an alkyl halide, reduction of an amide compound, or by the process described in *Shin-Jikken Kagaku Koza*, Vol. 14-3, p. 1608 (1978).

Synthesis of the typical compounds of formula (II) will be shown in the following Synthesis Examples.

SYNTHESIS EXAMPLE 5

Synthesis of Compound II-2

2-Hexyldecanoic acid (41.0 g) was refluxed in 40 ml of thionyl chloride for 1 hour. The excess thionyl chloride was removed by distillation under reduced pressure, and to the residue were added 6.8 g of piperazine, 50 ml of dimethylacetamide, 100 ml of ethyl acetate, and 25 ml of triethylamine at 15° to 20° C. with stirring over a period of 10 minutes. The reaction mixture was poured into 200 ml of cold water and extracted with 100 ml of ethyl acetate. The ethyl acetate layer was washed with two 200 ml portions of a saturated sodium chloride aqueous solution and dried over anhydrous magnesium sulfate. The solvent was evaporated under reduced pressure, and the residual oily substance was purified by silica gel column chromatography to obtain 41.0 g of an oily substance as an intermediate product.

To 20 ml of tetrahydrofuran was added 2.4 g of lithium aluminum hydride, and 11.2 g of the intermediate product above obtained was added thereto dropwise at 15° to 20° C. over 5 minutes with stirring. After the addition, the mixture was heated at 50° to 60° C. with stirring for 30 minutes. The inner temperature was decreased to 25° to 30° C., and 20 ml of ethyl acetate and 50 ml of water were slowly added dropwise to the reaction mixture. The mixture was extracted with 100 ml of ethyl acetate, and the extract was washed with 100 ml of a saturated sodium chloride aqueous solution and dried over anhydrous magnesium sulfate. The solvent was evaporated under reduced pressure, and the residual oily substance was purified by alumina column chromatography to obtain 8.9 g (83.6% based on the intermediate product) of a viscous colorless liquid.

The resulting product was identified to be compound II-2 by mass spectrum, NMR spectrum, and infrared absorption spectrum.

In formula (III), $R_{11}$ represents a hydrogen atom or an alkyl group having 1 to 4 carbon atoms, such as methyl, ethyl or n-butyl, and preferably a hydrogen atom or a methyl group.

$R_{12}$ and $R_{13}$ each independently represent an alkyl group having 1 to 20 carbon atoms (e.g., methyl, ethyl, n-butyl, 2-ethylhexyl, dodecyl or cyclohexyl), an aralkyl group (e.g., benzyl or phenethyl), an alkenyl group (e.g., allyl) or an alkynyl group (e.g., propargyl), with an alkyl group being preferred.

$L_1$ represents a divalent linking group having 1 to 24 carbon atoms and includes an alkylene group (e.g., methylene, ethylene, propylene or butylene), an arylene group (e.g., phenylene or naphthylene), an ether group, an amide group, an ester group, a thioether group, and two or more of these linking groups connected in series (e.g., phenylenemethylene, xylylene, phenyleneoxy, phenylenethio, ethyleneoxy, carboxyethylene, carbonylaminopropylene, carbonylaminobutylene, or phenylenemethyleneoxyhexylene).

Preferred among these linking groups are those containing an alkylene group at which they are bonded directly to the nitrogen atom of the tertiary amino group. Examples of such linking groups are an alkylene group, a phenylenealkylene group with the methylene group thereof bonded to the nitrogen atom, a xylylene group, a carboxyalkylene group with the alkylene group thereof bonded to the nitrogen atom, a carbonylaminoalkylene group, and a phenylenemethyleneoxyalkylene group. The most preferred of them is a phenylene group having 7 to 9 carbon atoms, such as a phenylenemethylene group (i.e., tolylene), a phenyleneethylene group or a phenylenepropylene group.

$R_{12}$, $R_{13}$, and $L_1$ may be taken together to form a nitrogen-containing 3- to 8-membered ring, preferably a 5- or 6-membered ring.

n1 represents 0 or 1, preferably 1.

$R_{11}$, $R_{12}$, $R_{13}$, and $L_1$ may have a substituent(s). Preferred substituents include a hydroxyl group, an alkoxy group (e.g., methoxy or ethoxy), an aryloxy group (e.g., phenoxy), an amino group, an alkylamino group, a carbamoyl group, a sulfamoyl group, a cyano group, and a halogen atom (e.g., fluorine, chloride, bromine or iodine).

The tertiary amine polymer which can be used in the present invention is a polymer having a tertiary amine residue in the main chain or side chain thereof. The terminology "tertiary amine residue" as used herein means a monovalent or polyvalent residual group obtained by removing any one or more hydrogen atoms from a tertiary amine represented by formula (V):

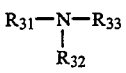

(V)

wherein $R_{31}$, $R_{32}$, and $R_{33}$ each independently represent an alkyl group, an aralkyl group, an alkenyl group or an alkynyl group.

Examples of the substituents represented by $R_{31}$, $R_{32}$, and $R_{33}$ are the same as those described above with respect to $R_{12}$, and $R_{13}$.

Of these tertiary amine polymers preferred are those comprising a repeating unit having the above-described formula (III) (hereinafter referred to as a vinyl polymer).

The present inventors have ascertained that the vinyl polymer of the present invention becomes more favorable to the object of the present invention with increasing basicity of the tertiary amine nitrogen atom of its repeating unit. Therefore, it is desirable that electronegative atoms, such as oxygen, nitrogen and sulfur, are remote from the nitrogen atom of the tertiary amino group. Specifically, it is preferable that these electronegative atoms are not bonded directly to the $\alpha$- or $\beta$-carbon atom on the tertiary amine nitrogen atom.

Specific but non-limiting examples of the repeating unit represented by formula (III) are shown below.

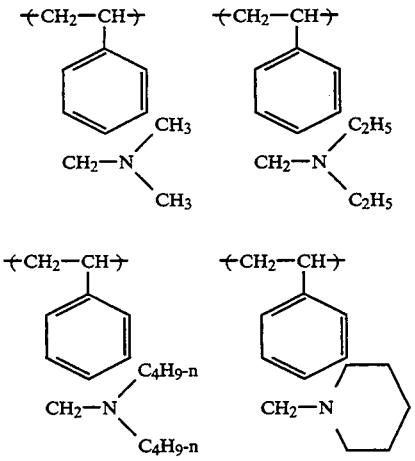

-continued

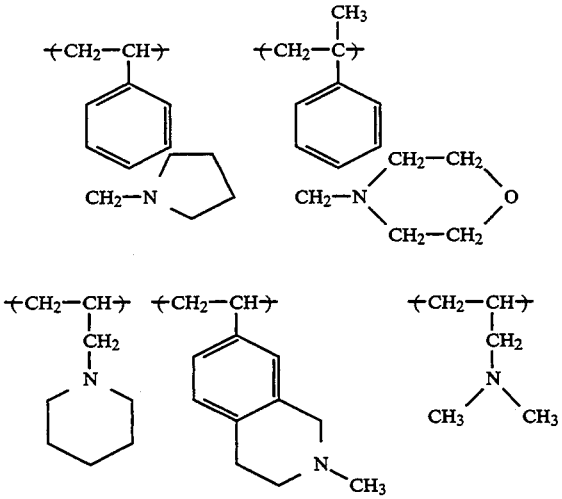

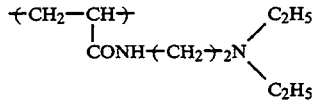

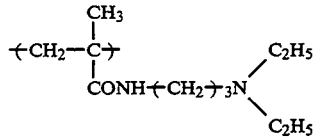

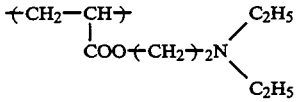

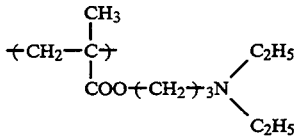

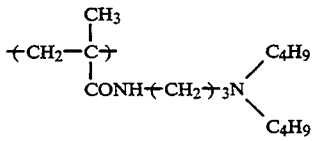

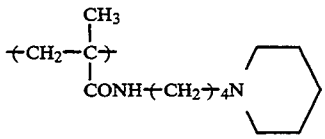

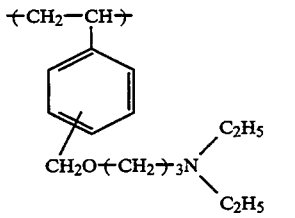

-continued

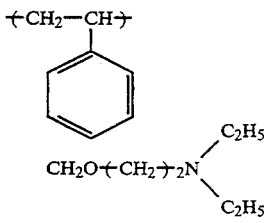

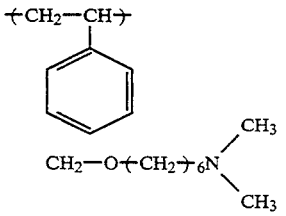

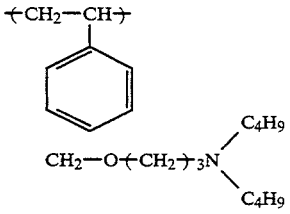

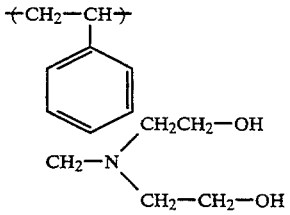

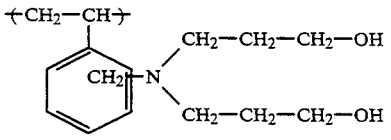

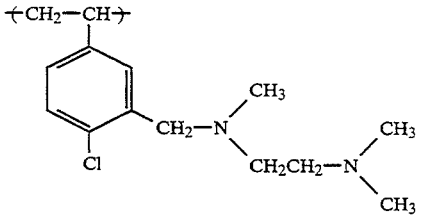

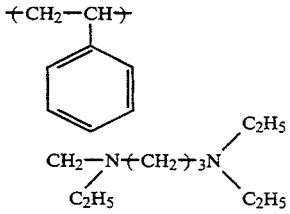

The vinyl polymers according to the present invention may contain repeating units derived from vinyl monomers other than the repeating unit of formula (III).

Examples of other vinyl monomers include monofunctional monomers, such as styrene, α-methylstyrene, p-methylstyrene, p-t-butylstyrene, n-ethylstyrene, chlorostyrene, propylene, 1-butene, isobutene, vinyl acetate, acrylic acid and esters thereof, methacrylic acid and esters thereof, acrylamide, methacrylamide, acrylonitrile, methacrylonitrile, N-vinylpyrrolidone, butadiene, vinylbenzyl alcohol, styrenesulfinic acid salts, and styrenesulfonic acid salts; and bifunctional monomers, such as divinylbenzene, ethylene glycol dimethacrylate, isopropylene glycol diacrylate, and tetramethylene glycol dimethacrylate.

The most preferred tertiary amine polymers to be used in the present invention are latex polymers comprising the repeating unit of formula (III) and a repeating unit represented by formula (IV):

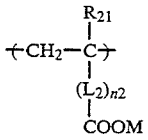

(IV)

wherein $R_{21}$ represents a hydrogen atom or an alkyl group; $L_2$ represents a divalent linking group; n2 represents 0 or 1; and M represents a hydrogen atom or an alkali metal atom.

$R_{21}$ preferably represents a hydrogen atom or an alkyl group having 1 to 4 carbon atoms, e.g., methyl, ethyl or n-butyl, with a hydrogen atom and a methyl group being still preferred.

$L_2$ has the same meaning as $L_1$ in formula (III). It is preferably an arylene group.

n2 is preferably 0.

The alkali metal atom as M includes lithium, sodium, potassium, rubidium, and cesium. M preferably represents a hydrogen atom or potassium.

Specific but non-limiting examples of the repeating unit represented by formula (IV) are shown below.

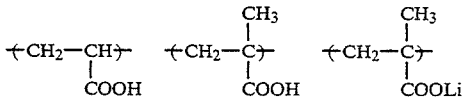

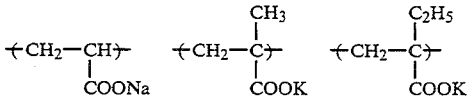

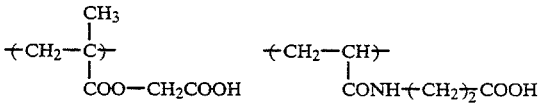

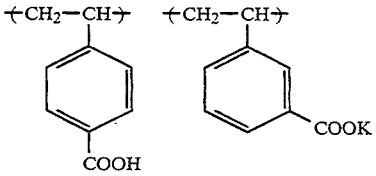

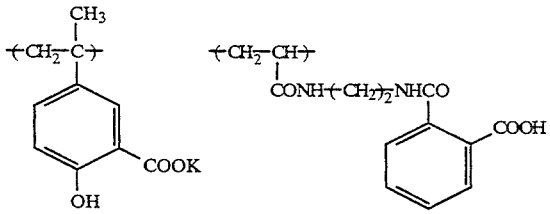

-continued
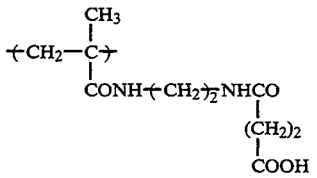
Specific but non-limiting examples of the vinyl polymers which can be used in the present invention for preference are shown below.
V-1
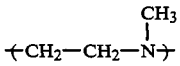
V-2
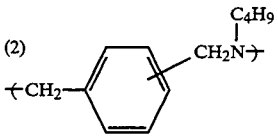
V-3
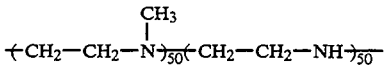
V-4
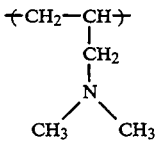
V-5
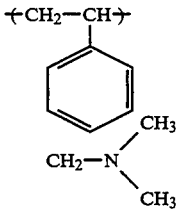
V-6
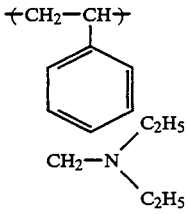
V-7
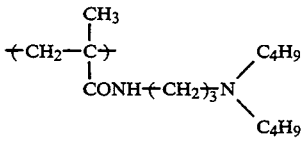
V-8
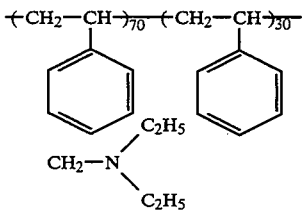
V-9
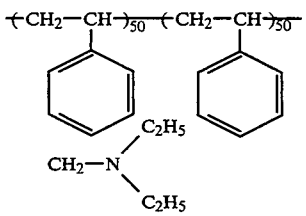

-continued
V-10
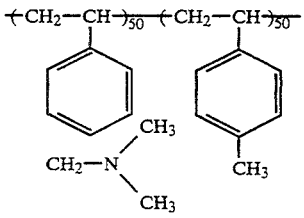
V-11
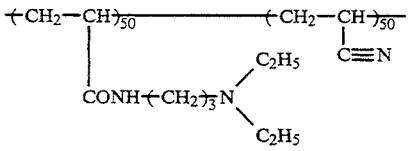
V-12
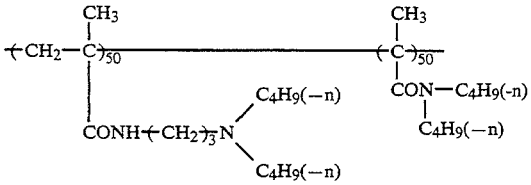
V-13
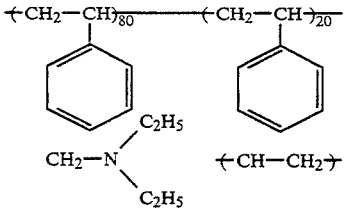
V-14
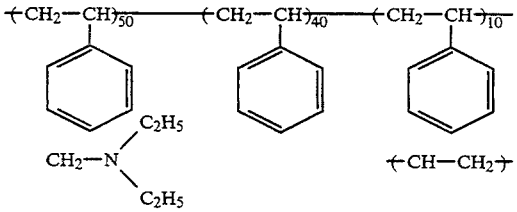
V-15
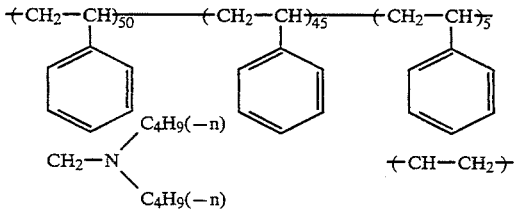
V-16
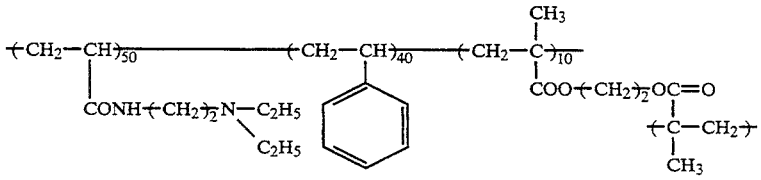
V-17
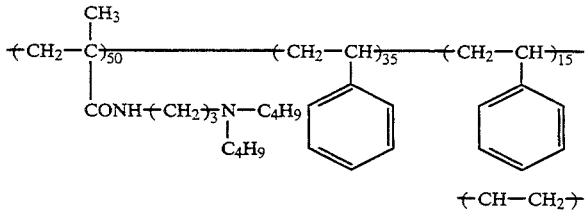

-continued
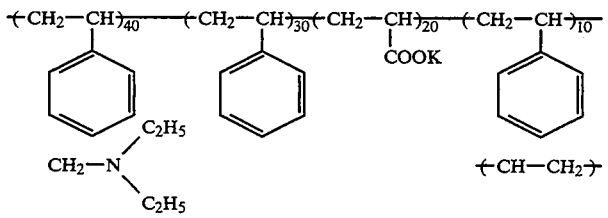
V-18
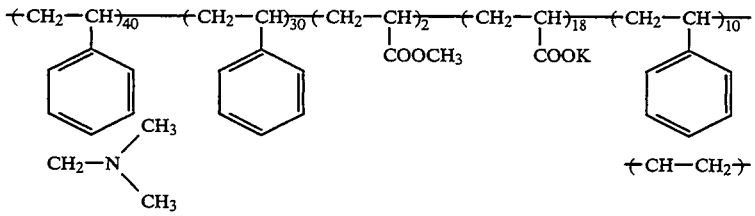
V-19
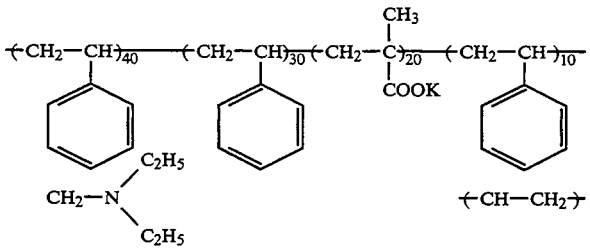
V-20
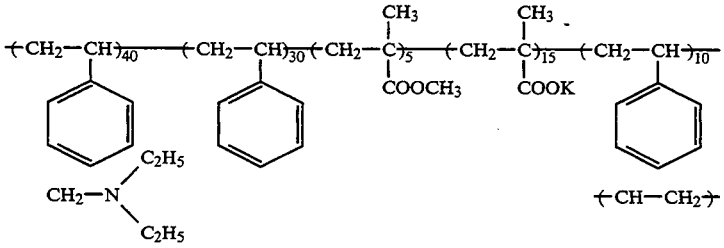
V-21
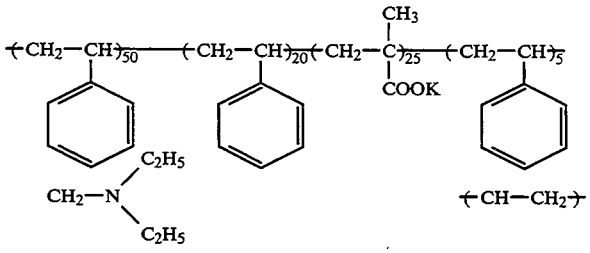
V-22
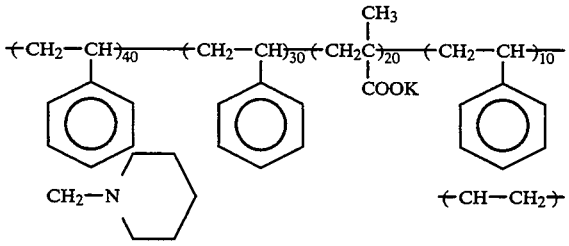
V-23

-continued

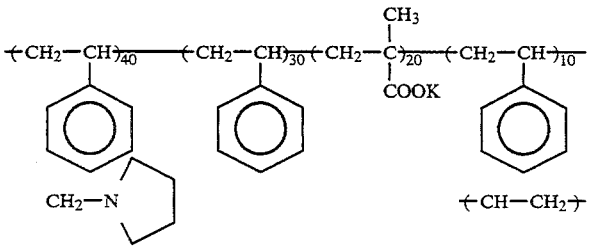

V-24

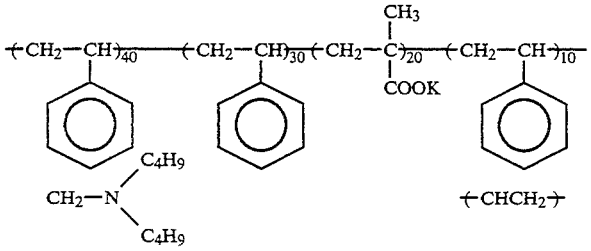

V-25

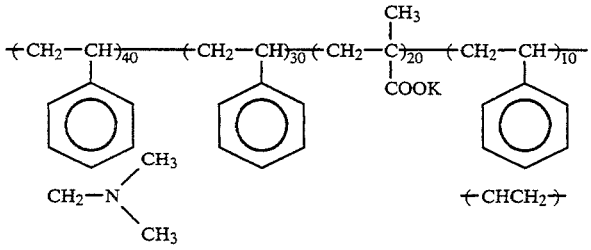

V-26

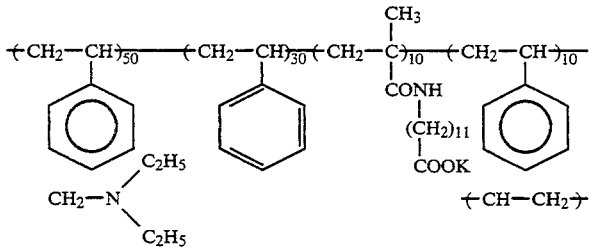

V-27

The vinyl polymers of the present invention can be prepared as follows.

Those having a tertiary amine residue in the main chain thereof are synthesized by ionic polymerization of N-alkylaziridine or substitution reaction between N,N'-dialkylalkylenediamines and dihalides, such as 1,4-dibromobutane.

Those having a tertiary amine residue in the side chain thereof are synthesized most conveniently by radical polymerization of a vinyl monomer having a tertiary amine residue. They may also be prepared by radical polymerization of a vinyl monomer having a group capable of being converted to a tertiary amino group, such as chloromethylstyrene, followed by substitution reaction to convert the group to a tertiary amino group.

Radical polymerization can be effected by any of solution polymerization, bulk polymerization, suspension polymerization, dispersion polymerization, and emulsion polymerization. Synthesis of the above-mentioned latex polymers should be performed by emulsion polymerization.

Emulsions polymerization is generally carried out in the presence of at least one surface active agent selected from anionic surface active agents (e.g., "Triton", produced by Rohm & Haas Co.), cationic surface active agents (e.g., cetyltrimethylammonium chloride), and nonionic surface active agents (e.g., polyvinyl alcohol).

Specific examples of the synthesis of the tertiary amine polymers are described below for illustrative purposes only but not for limitation.

SYNTHESIS EXAMPLE 6

Synthesis of Polymer V-6

1) Preparation of Diethylaminomethylstyrene:

In a 3 l reaction vessel were charged 500 ml of N,N-dimethylformamide, 378 g of diethylamine, and 10 g of a polymerization inhibitor Irganox 1010, produced by Ciba-Geigy Ltd. To the mixture at 40° C. was added dropwise 100 g of chloromethylstyrene (a 60:40 mixture of meta-compound and para-compound) with stirring, taking care not to raise the inner temperature above 60° C. After the addition, the inner temperature was elevated to 75° C., at which the reaction mixture was stirred for 3 hours. The reaction mixture was poured into 5 l of water and extracted with 3 l of n-hexane. The aqueous layer was removed, and the extract was further extracted with a mixed solvent of 425 ml of concentrated hydrochloric acid and 425 ml of water. The hexane layer was removed, and a solution of 300 g of sodium hydroxide in 3 l of water was added, and the mixture was extracted with n-hexane. The hexane layer was dried over 20 g of magnesium sulfate and distilled under reduced pressure. The fraction of from 90° to 100° C. was recovered to obtain 70 g of diethylaminomethylstyrene.

2) Polymerization:

Thirty grams of diethylaminomethylstyrene were mixed with 70 ml of N,N-dimethylformamide, and 0.3 g of azobisisobutyronitrile was added thereto. The mixture was heated at 80° C. for 2 hours while stirring. Azobisisobutyronitrile (0.3 g) was again added to the reaction mixture, followed by heating at 80° C. with stirring for an additional period of 4 hours. After cooling to 25° C., the reaction mixture was poured into water, and the solid matter was collected by filtration and dried to obtain 24 g of polymer (6).

SYNTHESIS EXAMPLE 7

Synthesis of Polymer V-9

Diethylaminomethylstyrene (37.8 g) and 10.4 g of styrene were mixed with 90 ml of N,N-dimethylformamide, and 0.4 g of azobisisobutyronitrile was added thereto, followed by heating at 80° C. for 2 hours while stirring. Azobisisobutyronitrile (0.4 g) was added to the reaction system, and the system was further heated at 80° C. for an additional period of 4 hours. After cooling to 25° C., the reaction mixture was poured into water, and the solid matter was collected by filtration and dried to obtain 41 g of polymer (9).

SYNTHESIS EXAMPLE 8

Synthesis of Polymer V-17

1) Preparation of N-Dibutylaminopropylmethacrylamide:

A mixture of 180 g of dibutylaminopropylamine, 200 ml of triethylamine, and 500 ml of N,N-dimethylformamide was kept at 10° C. or lower, and 100 g of methacryl chloride was slowly added thereto dropwise. After stirring at 20° C. for 1 hour, the reaction mixture was poured into 3 l of water and extracted with 1.5 l of ethyl acetate. The ethyl acetate layer was washed with three 1 l portions of a saturated sodium chloride aqueous solution and dried over 20 g of magnesium sulfate. Magnesium sulfate was removed, and the mother liquor was distilled under reduced pressure to recover 200 g of N-dibutylaminomethacrylamide as a fraction of 150° to 170° C.

2) Polymerization:

In a reaction vessel equipped with a stirrer were charged 180 ml of water, 0.2 g of sodium hydrogensulfite, 0.6 g of sodium hydrogencarbonate, and 12 g of a surface active agent Nissan Traks H-30, produced by Nippon Oil & Fats Co., Ltd. While heating the mixture at 80° C. with stirring in a nitrogen stream, a monomer mixture of 25.4 g of N-dibutylaminomethacrylamide, 7.28 g of styrene, and 3.9 g of divinylbenzene and 30 ml of an aqueous solution containing 0.4 g of potassium persulfate were simultaneously added thereto dropwise over a period of 2 hours. After completion of the reaction, additional 0.14 g of potassium persulfate was added to the reaction mixture, followed by stirring at the same temperature for 2 hours. The reaction mixture was cooled to 25° C., and the agglomerate formed in slight quantity was removed by filtration to recover 250 g of an aqueous dispersion (latex) of polymer (17). The latex had a solid content of 16.7% and an average particle size of 58 nm as measured with a Coulter submicron analyzer.

SYNTHESIS EXAMPLE 9

Synthesis of Polymer V-20

In a reaction vessel equipped with a stirrer were charged 340 ml of water, 2.5 g of sodium hydrogencarbonate, and 42 g of a surface active agent Nissan Traks H-30, and the mixture was kept at 80° C. while stirring in a nitrogen stream. A monomer mixture of 75.6 g of N-dibutylaminomethylstyrene, 31.2 g of styrene, 20 g of methyl methacrylate, and 13 g of divinylbenzene and 100 ml of an aqueous solution containing 1.7 g of potassium persulfate were simultaneously added thereto dropwise over a period of 2 hours. After the addition, additional 1.0 g of potassium persulfate was added to the reaction mixture, followed by stirring at the same temperature for 1 hour. Then, 400 ml of a 0.5N potassium hydroxide aqueous solution was added thereto dropwise over 1 hour, followed by heating for 4 hours with stirring. The reaction mixture was cooled to 25° C., followed by filtration to obtain 1020 g of an aqueous dispersion (latex) of polymer (20). The latex had a solid content of 16.4% and an average particle size of 75 nm.

SYNTHESIS EXAMPLE 10

Synthesis of Polymer V-27

1) Preparation of 12-Methacryloylaminododecanoic Acid:

In 9 l of water at 30° C. were dissolved 218 g of 12-aminododecanoic acid and 100 g of sodium hydroxide (purity: 93%), and 102 ml of methacryl chloride was added thereto over 1 hour while stirring. The reaction mixture was stirred for 2 hours and then heated to 60° C., at which 3 l of ethyl acetate and 300 ml of concentrated hydrochloric acid were added thereto successively. The mixture was filtered while hot (60° C.) to remove any insoluble matter, followed by liquid-liquid separation. The organic layer was dried over 30 g of magnesium sulfate and, after removal of the magnesium sulfate, cooled to 10° C., at which 6 l of n-hexane was added, whereupon a precipitate was formed. The precipitate was collected by filtration and thoroughly washed with 1 l of n-hexane. Recrystallization of the precipitate from 500 ml of ethyl acetate yielded 128 g of 12-methacryloylaminododecanoic acid.

2) Polymerization:

In a reaction vessel equipped with a stirrer were charged 265 ml of water, 0.65 g of sodium hydrogensulfite, and 18.5 g of a surface active agent Nissan Traks H-30, produced by Nippon Oil & Fats Co., Ltd. While heating the mixture at 80° C. with stirring in a nitrogen stream, a monomer mixture of 47.3 g of diethylaminomethylstyrene, 15.6 g of styrene, and 6.5 g of divinylbenzene and a monomer aqueous solution of 13.5 g of 12-methacryloylaminododecanoic acid, 3.3 g of 85% potassium hydroxide, and 0.8 g of potassium persulfate in 100 ml of water were simultaneously added thereto dropwise over a period of 2 hours. After completion of the addition, additional 50 g of an aqueous solution containing 0.3 g of potassium persulfate was added to the reaction mixture, followed by stirring under heating for 2 hours. The reaction mixture was cooled to 25° C., and the agglomerate formed in slight quantity was removed by filtration to recover 510 g of an aqueous dispersion (latex) of polymer (27). The latex had a solid content of 18.0% and an average particle size of 51 nm as measured with a Coulter submicron analyzer.

The content of the tertiary amine moiety in the vinyl polymer of the present invention is preferably such that the polymer weighs not more than 2000 g, still preferably not more than 600 g, per gram equivalent of a tertiary amine.

The compound of formula (I) is preferably used in an amount of from 0.1 to 500 mols, still preferably from 20 to 300 mols, and most preferably from 50 to 200 mols, per mole of a dye-forming compound.

The compound of formula (II) and/or the vinyl polymer having repeating unit of formula (III) is/are preferably used in a total amount of from 0.3 to 10 g/m$^2$, still preferably from 0.5 to 5 g/m$^2$.

The compound of formula (I) is preferably added to a layer to which a dye-forming compound is added. The compound of formula (II) and/or the vinyl polymer is/are added to any of (1) a light-sensitive sheet, (2) an image-receiving sheet, (3) a cover sheet, and (4) a processing composition.

The compounds of formula (I) may be used either individually or as a mixture of two or more thereof at an arbitrary mixing ratio.

While the compound of formula (II) may be added to any layer of the film unit, a monosheet type film unit preferably contains this compound (1) in the uppermost layer of a transparent cover sheet, (2) between a dye-generating layer and an image-receiving layer, or (3) in a layer other than the layer between a dye-generating layer and an image-receiving layer, still preferably (3) in a layer other than the layer between a dye-generating layer and an image-receiving layer; and a peel-apart type film unit preferably contains this compound (1) in a layer between a dye-generating layer and an image-receiving layer or (2) in a layer other than a layer between a dye-generating layer and an image-receiving layer, still preferably (2) in a layer other than a layer between a dye-generating layer and an image-receiving layer.

The vinyl polymer is most preferably added to a processing composition.

The compound of formula (I) or (II) can be incorporated into a hydrophilic colloidal layer by various known techniques, usually an oil-in-water dispersion method as an oil protect method, in which the compound is dissolved in a high-boiling organic solvent, such as a phosphoric ester or a phthalic ester, and a low-boiling auxiliary solvent, and the solution is dispersed in a gelatin aqueous solution containing a surface active agent. The oil-in-water dispersion may also be prepared by adding water or a gelatin aqueous solution to a solution of the compound containing a surface active agent, and inverting the phase. A dispersion method known as a Fischer's dispersion method may be used for dispersion of an alkali-soluble compound. The resulting dispersion is preferably subjected to distillation, noodle washing or ultrafiltration, and the like to remove the low-boiling organic solvent.

Suitable dispersing media for the compounds of formulae (I) and (II) include high-boiling organic solvents having a dielectric constant of 2 to 20 (at 25° C.) and a refractive index of 1.4 to 1.7 and water-insoluble high polymers described in U.S. Pat. No. 4,857,449, Cls. 7–15 and WO 88/00723, pp. 12–30. The dispersing medium is preferably used at a weight ratio of 0.1 to 10, still preferably 0.3 to 3, to each of the compound of formula (I) and the compound of formula (II).

For manifestation of the effects of the compound of formula (I), it is preferably added to a layer to which a dye-forming compound is added as mentioned above. In this case, the compound may be emulsified together with a dye-forming compound, or a separately prepared emulsion of the compound may be added to the layer.

The vinyl polymer is preferably added in the form of a latex as mentioned above. In this case, the compound can be used as an aqueous dispersion prepared in the presence of a surface active agent.

The tertiary amine polymer of the present invention is preferably used in an amount of from 0.1 to 70 mmol/m$^2$, still preferably from 0.5 to 20 mmol/m$^2$, in terms of tertiary amine unit. The tertiary amine polymer can be incorporated into a processing solution by any arbitrary method. For example, a latex dispersion may be added directly to a processing solution, or a linear polymer may be emulsified and dispersed in the processing solution.

The processing composition containing the tertiary amine polymer is preferably an alkali processing composition.

The processing composition is uniformly spread on a light-sensitive element after the light-sensitive element is exposed to light to develop the light-sensitive material and, at the same time, serves to completely shield the light-sensitive layer from the outside light in cooperation with a light-shielding layer provided on the back of the support of the light-sensitive element or on the side opposite to the processing solution. Accordingly, the composition usually contains an alkali, a thickener, a developing agent, a development controlling agent, a development accelerator, a development inhibitor, an antioxidant for preventing deterioration of a developing agent, and the like. If desired, the composition may contain a light-shielding agent.

The alkali is used in an amount enough to adjust the composition to pH between 12 and 14. Suitable alkalis include alkali metal hydroxides, such as sodium hydroxide, potassium hydroxide, and lithium hydroxide; alkali metal phosphates, such as potassium phosphate; guanidine derivatives; and quaternary amine hydroxides, such as tetramethylammonium hydroxide; with potassium hydroxide and sodium hydroxide being preferred.

The thickener is necessary for making the composition uniformly spreadable and for assuring intimate contact between a light-sensitive layer and a cover sheet. Useful thickeners include polyvinyl alcohol, hydroxyethyl cellulose, and alkali metal salts of carboxymethyl cellulose, with hydroxyethyl cellulose and sodium carboxymethyl cellulose being preferred.

The light-shielding agent includes any kind of dyes and pigments and mixtures thereof as long as it does not diffuse into a dye image-receiving layer to cause stains. Carbon black is a typical light-shielding agent.

The developing agent includes all the kinds known in the art as long as capable of cross oxidizing a dye-forming substance and causing no substantial stains even when oxidized. The developing agent may be used either individually or in combination of two or more thereof. It may be used in the form of a precursor thereof. The developing agent may be incorporated into either an appropriate layer of a light-sensitive element or an alkali processing solution. Useful developing agents include aminophenol derivatives and pyrazolidinone derivatives, with pyrazolidinone derivatives being preferred for suppression of stains.

Examples of the pyrazolidinone developing agents are 1-phenyl-3-pyrazolidinone, 1-p-tolyl-4,4-dihydroxymethyl-3-pyrazolidinone, 1-(3'-methylphenyl)-4-methyl-4-hydroxymethyl-3-pyrazolidinone, 1-phenyl-4-methyl-4-hydroxymethyl-3-pyrazolidinone, and 1-p-tolyl-4-methyl-4-hydroxymethyl-3-pyrazolidinone.

A light-sensitive sheet, a cover sheet or an alkali processing composition may contain a development accelerator described in JP-A-62-215272, pp. 72–91, a hardening agent described in ibid, pp. 146–155, a surface active agent described in ibid, pp. 201–210, a fluorine-containing compound described in ibid, pp. 210–222, a thickener described in ibid, pp. 225–227, an antistatic agent described in ibid, pp. 227–230, a polymer latex described in ibid, pp. 230–239, and a matting agent described in ibid, p. 240.

The elements constituting the color diffusion transfer film unit of the present invention will be explained below.

I. Light-sensitive Sheet:

A) Support:

Any of smooth supports generally used in photographic materials, such as cellulose acetate, polystyrene, polyethylene terephthalate, and polycarbonate, can be used. A subbing layer is preferably provided on the support. A transparent support preferably contains a trace amount of a dye or a pigment (e.g., titanium oxide) in order to prevent light piping.

The support has a thickness of 50 to 350 μm, preferably 70 to 210 μm, still preferably 80 to 150 μm.

If desired, a backing layer for curl balance or an oxygen-barrier layer (see JP-A-56-78833) may be provided on the back side of the support.

B) Image-Receiving Layer:

A dye image-receiving layer comprises a hydrophilic colloid containing a mordant. The image-receiving layer may have a single layer structure or a multi-layer structure in which a plurality of mordants different in mordanting capability are applied in layers. For the details of the multi-layered image-receiving layer, refer to JP-A-61-252551.

A polymer mordant is preferably used. A polymer mordant includes polymers containing a secondary or tertiary amino group, polymers having a nitrogen-containing heterocyclic moiety, and polymers containing a quaternary cation, each having a molecular weight of 5,000 or more, preferably 10,000 or more.

The mordant is applied in an amount usually of from 0.5 to 10 g/m$^2$, preferably of from 1.0 to 5.0 g/cm$^2$, still preferably of from 2 to 4 g/m$^2$.

The hydrophilic colloid includes gelatin, polyvinyl alcohol, polyacrylamide, and polyvinyl pyrrolidone, with gelatin being preferred.

If desired, the image-receiving layer may contain a discoloration inhibitor as described in JP-A-62-30620, JP=A-62-30621, and JP-A-62-215272.

C) White Reflecting Layer:

A white reflecting layer serving as a white background for a color image generally comprises a white pigment and a hydrophilic binder. Suitable white pigments include barium sulfate, zinc oxide, barium stearate, silver flakes, silicates, alumina, zirconium oxide, sodium zirconium sulfate, kaolin, mica, and titanium dioxide. Non-film-forming polymer particles, such as polystyrene particles, may also serve for whiteness. These white pigments may be used either individually or as a mixture thereof so as to control the reflectance as desired. A particularly useful white pigment is titanium dioxide.

While the degree of whiteness of the white reflecting layer varies with the kind and amount of the pigment or the pigment to binder mixing ratio, the reflecting layer preferably has a reflectance of 70% or higher. In general, the degree of whiteness increases with the pigment content. However, since the pigment particles in the reflecting layer also act as a barrier against diffusion of an image-forming dye passing therethrough, the amount of the pigment to be applied should be selected properly.

For example, titanium dioxide is preferably used in an amount of 5 to 40 g/m$^2$, still preferably 10 to 25 g/m$^2$, to form a reflecting layer which reflects 78 to 85% of light having a wavelength of 540 nm.

Titanium dioxide to be used may be chosen from various grades available on the market. In particular, titanium dioxide of rutile type is preferred. Many of commercially available titanium dioxide grades have their surface treated with alumina, silica, zinc oxide, etc. It is preferable for assuring a high reflectance to use those grades having been surface-treated with 5% or more of such a surface treating agent. Examples of commercially available titanium dioxide grades include Ti-Pure R931 produced by E. I. du Pont de Nemours & Co., Inc. and those described in *Research Disclosure* No. 15162.

The hydrophilic binder to be used includes alkali-penetrable high polymer matrices, such as gelatin, polyvinyl alcohol, and cellulose derivatives, e.g., hydroxyethyl cellulose, an carboxymethyl cellulose, with gelatin being particularly preferred. A weight ratio of the white pigment to gelatin ranges from 1/1 to 20/1, preferably 5/1 to 10/1.

The white reflecting layer preferably contains such a discoloration inhibitor as disclosed in JP-B-62-30620 and JP-A-62-30621.

D) Light-Shielding Layer:

A light-shielding layer comprising a light-shielding agent and a hydrophilic binder is provided between a white reflecting layer and a light-sensitive layer.

While any material having a light-shielding function may be employed as a light-shielding agent, carbon black is preferred. Degradable dyes described in U.S. Pat. No. 4,615,966 are also useful as a light-shielding agent.

The hydrophilic binder is not particularly limited as long as capable of dispersing carbon black. Gelatin is a preferred binder.

Carbon black to be used is not particularly limited by a method of production. For example, carbon black manufactured by a channel method, a thermal method, a furnace method, and the like as described in Donnel Voet, *Carbon Black*, Marcel Dekker, Inc. (1976) can be employed. While not limiting, the carbon black preferably has a particle size of 90 to 1800 Å.

The amount of the light-shielding agent (e.g., carbon black) to be added is decided according to the sensitivity of a light-sensitive material to be shielded from light. In general, it corresponds to an optical density of about 5 to 10.

E) Light-Sensitive Layer:

In the present invention, a light-sensitive layer comprising a silver halide emulsion layer combined with a dye image-forming substance is provided over the above-mentioned light-shielding layer.

E-1) Dye Image-forming Substance:

The dye image-forming substance which can be used in the present invention is a nondiffusion compound capable of releasing a diffusing dye or a precursor thereof in proportion to silver development or a compound capable of changing its diffusibility in proportion to silver development. These dye image-forming substances are described in *The Theory of the Photographic Process*, the 4th Ed. They are all represented by formula (VI):

$$(DYE\text{-}Y)_n\text{-}Z \qquad (VI)$$

wherein DYE represents a dye group, a dye group temporarily shifted to a short wavelength, or a dye precursor group; Y represents a single bond or a linking group; Z represents a group which, either correspondingly or inverse-correspondingly to a light-sensitive silver salt forming a latent image, changes the diffusibility of the compound represented by $(DYE\text{-}Y)_n\text{-}Z$ or releases DYE to produce a difference in diffusibility between the released DYE and $(DYE\text{-}Y)_n\text{-}Z$; and n represents 1 or 2; when n is 2, two (DYE-Y)'s may be the same or different.

The dye image-forming compounds of formula (VI) are divided into negatively working compounds which become diffusible in a silver developed area and positively working compounds which become diffusible in an undeveloped area according to the function of the group Z.

The negative type Z includes groups which are oxidized and split as a result of silver development to release a diffusing dye. Specific examples of the negative type Z are described in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,135,929, 4,336,322, and 4,139,389, JP-A-53-50736, JP-A-51-104343, JP-A-54-130122, JP-A-53-110827, JP-A-56-12642, JP-A-56-16131, JP-A-57-4043, JP-A-57-650, JP-A-57-20735, JP-A-53-69033, JP-A-54-130927, JP-A-56-164342, and JP-A-57-119345.

Of the negative Z groups of negatively dye-releasing redox compounds, an N-substituted sulfamoyl group (the substituent including an aromatic hydrocarbon ring or a heterocyclic ring) is preferred. Illustrative examples of such an N-substituted sulfamoyl group are shown below.

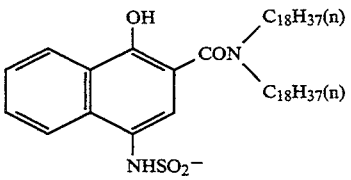

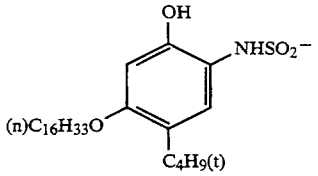

-continued

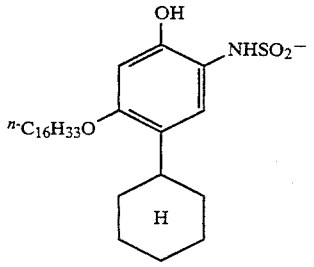

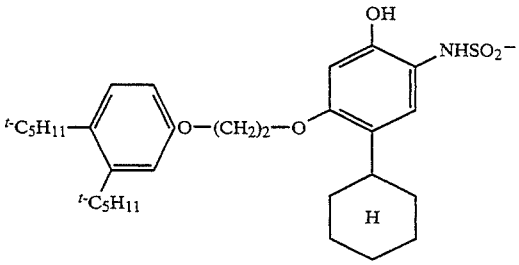

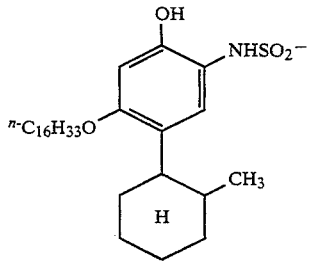

Positively working compounds are described in *Ange. Chem. Inst. Ed. Engl.*, Vol. 22, p. 191 (1982).

For example, positively working compounds include compounds called dye developers which are diffusible in the initial alkaline condition but becomes non-diffusing on being oxidized by development. Typical examples of positive type Z groups useful for this type of compounds are given in U.S. Pat. No. 2,983,606.

Another type is compounds which release a diffusing dye through, for example, self-cyclization under an alkaline condition but substantially stop dye release on being oxidized by development. Specific examples of Z having such a function are described in U.S. Pat. No. 3,980,479, JP-A-53-69033, JP-A-54-130927, and U.S. Pat. Nos. 3,421,964 and 4,199,355.

Still another type is compounds which do not release a dye by themselves but release a dye on being reduced. Compounds of this type are used in combination with an electron donor and react with a residual electron donor imagewise oxidized by silver development thereby to release a diffusing dye imagewise. Specific examples of Z having such a function are described, e.g., in U.S. Pat. Nos. 4,183,753, 4,142,891, 4,278,750, 4,139,379, and 4,218,368, JP-A-53-110827, U.S. Pat. Nos. 4,278,750, 4,356,249, and 4,358,525, JP-A-53-110827, JP-A-54-130927, JP-A-56-164342, Technical Disclosure Bulletin 87-6199, and EP-A2-220746. Illustrative examples of these groups are shown below.

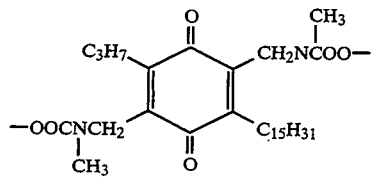

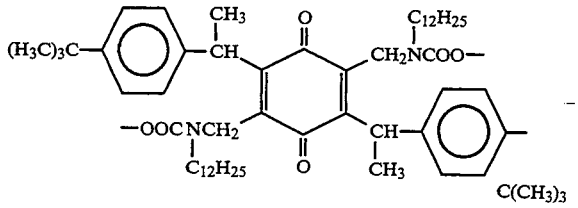

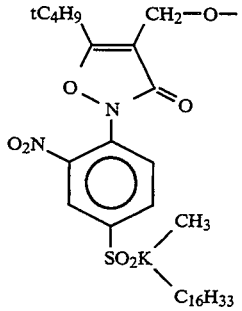

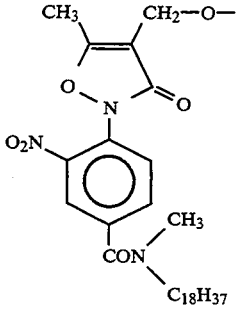

In using the compound of this type, it is preferably combined with a nondiffusion electron-donating compound known as an ED compound or a precursor thereof. Examples of the ED compound are described in U.S. Pat. Nos. 4,263,393 and 4,278,750 and JP-A-56-138736.

Additionally the following compounds are also useful as a dye image-forming substance.

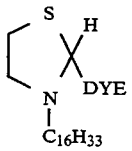

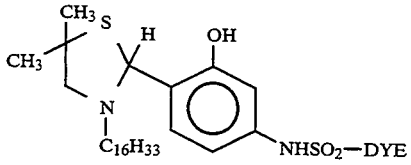

wherein DYE has the same meaning as defined for formula (VI). The details of these compounds are described in U.S. Pat. Nos. 3,719,489 and 4,098,783.

Specific examples of the dyes derived from the dye groups or dye precursor groups represented by DYE in the foregoing formulae are described in the following publications:

Yellow Dyes:

U.S. Pat. Nos. 3,597,200, 3,309,199, 4,013,633, 4,245,028, 4,156,609, 4,139,383, 4,195,992, 4,148,641, 4,148,643, and 4,336,322, JP-A-51-114930, JP-A-56-71072, *Research Disclosure* 17630 (1978), and ibid 16475 (1977).

Magenta Dyes:

U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, JP-A-52-106727, JP-A-53-23628, JP-A-55-36804, JP-A-56-73057, JP-A-56-71060, and JP-A-55-134.

Cyan Dyes:

U.S. Pat. Nos. 3,482,972, 3,929,760, 4,013,635, 4,268,625, 4,171,220, 4,242,435, 4,142,891, 4,195,994, 4,147,544, and 4,148,642, British Patent 1,551,138, JP-A-54-99431, JP-A-52-8827, JP-A-53-47823, JP-A-53-143323, JP-A-54-99431, JP-A-56-71061, European Patents 53,037 and 53,040, *Research Disclosure* 17630 (1978), and ibid 16475 (1977).

These dye image-forming compounds can be dispersed according to the methods described in JP-A-62-215272, pp. 144–146. The dispersion of the dye image-forming compound may contain the compounds described in JP-A-62-215272, pp. 137–144.

(E-2) Silver Halide Emulsion:

The silver halide emulsions which can be used in the present invention may be either negative emulsions which form a latent image mainly on the surface of silver halide grains or internal latent image type direct positive emulsions which form a latent image in the inside of silver halide grains.

The internal latent image type direct positive emulsions include so-called "conversion type" emulsions which are prepared by making use of a difference in solubility of silver halides and "core/shell type" emulsions in which at least the light-sensitive site of a silver halide internal nucleus (core) having been subjected to doping with a metallic ion and/or chemical sensitization is covered with a silver halide outer shell. The details for these emulsion types are described in U.S. Pat. Nos. 2,592,250 and 3,206,313, British Patent 1,027,146, U.S. Pat. Nos. 3,761,276, 3,935,014, 3,447,927, 2,297,875, 2,563,785, 3,551,662, and 4,395,478, West German Patent 2,728,108, and U.S. Pat. No. 4,431,730.

Where an internal latent image type direct positive emulsion is used, it is necessary to give silver halide grains a surface fogging nucleus after imagewise exposure by using light or a nucleating agent.

Nucleating agents to be used include hydrazines described in U.S. Pat. Nos. 2,563,785 and 2,588,982; hydrazines and hydrazones described in U.S. Pat. No. 3,227,552; heterocyclic quaternary salt compounds described in British Patent 1,283,835, JP-A-52-69613 and U.S. Pat. Nos. 3,615,615, 3,719,494, 3,734,738, 4,094,683, and 4,115,122; sensitizing dyes having in the dye molecule thereof a substituent having nucleating action described in U.S. Pat. No. 3,718,470; thiourea-bonded acylhydrazine compounds described in U.S. Pat. No. 4,030,925, 4,031,127, 4,245,037, 4,255,511, 4,266,013, and 4,276,364, and British Patent 2,012,443; and acylhydrazine compounds having bonded thereto a thioamide ring or a hetero ring, e.g., triazole or tetrazole, as an adsorbing group as described in U.S. Pat.

Nos. 4,080,270 and 4,278,748, and British Patent 2,011,391B.

The above-mentioned negative emulsions or internal latent image type direct positive emulsions are used in combination with spectral sensitizing dyes. Specific examples of useful spectral sensitizing dyes are described in JP-A-59-180550, JP-A-60-140335, Research Disclosure 17029, and U.S. Pat. Nos. 1,846,300, 2,078,233, 2,089,129, 2,165,338, 2,231,658, 2,917,516, 3,352,857, 3,411,916, 2,295,276, 2,481,698, 2,688,545, 2,921,067, 3,282,933, 3,397,060, 3,660,103, 3,335,010, 3,352,680, 3,384,486, 3,623,881, 3,718,470, and 4,025,349.

(E-3) Constitution of Light-Sensitive Layer:

Reproduction of a natural color by a subtractive color process is achieved by using a light-sensitive layer comprising a combination of at least a light-sensitive emulsion spectrally sensitized with the above-described spectral sensitizing dye and the above-described dye image-forming substance providing a dye having a selective spectral absorption in the same wavelength range (hereinafter referred to as a combination unit). The emulsion and the dye image-forming substance may be provided in separate layers or may be mixed together and provided in one layer. Where a dye image-forming substance used is such that exhibits an absorption in the spectral sensitivity region of the emulsion with which it is combined when it is applied in layer, it is preferably provided in a separate layer. The emulsion layer may be comprised of a plurality of emulsion layers different in sensitivity. An arbitrary layer may be provided between an emulsion layer and a dye image-forming substance layer. For example, a layer containing a nucleation development accelerator described in JP-A-60-173541 or a partitioning layer described in JP-B-60-15267 may be provided to increase the dye image density, or a reflecting layer may be provided to increase the sensitivity of a light-sensitive element.

The reflecting layer contains a white pigment, preferably titanium oxide, and a hydrophilic binder, preferably gelatin. Titanium oxide is applied in an amount of 0.1 to 8 g/m$^2$, preferably 0.2 to 4 g/m$^2$. Examples of suitable reflecting layers are described in JP-A-60-91354.

A preferred multi-layer structure of a light-sensitive layer comprises a blue-sensitive combination unit, a green-sensitive combination unit, and a red-sensitive combination unit in this order from the side to be exposed.

If desired, an arbitrary layer may be interposed among combination units. In particular, it is recommended to provide an intermediate layer between two combination units so as to prevent the development of an emulsion layer from adversely affecting the adjacent emulsion layer.

Where a development agent is used in combination with a nondiffusion dye image-forming substance, the intermediate layer preferably contains a nondiffusion reducing agent so as to prevent diffusion of an oxidation product of the developing agent. Such a nondiffusion reducing agent includes non-diffusing hydroquinone, sulfonamidophenol and sulfonamidonaphthol. Specific examples are described in JP-A-50-21249, JP-A-50-23813, JP-A-49-106329, JP-A-49-129535, U.S. Pat. Nos. 2,336,327, 2,360,290, 2,403,721, 2,544,640, 2,732,300, 2,782,659, 2,937,086, 3,637,393, and 3,700,453, British Patent 557,750, JP-A-57-24941, and JP-A-58-21249. Methods for preparing dispersions of these nondiffusion reducing agents are described in JP-A-60-238831 and JP-B-60-18978.

Where a compound capable of releasing a diffusing dye by a silver ion as described in JP-B-55-7576 is used, an intermediate layer containing a compound capturing the silver ion is preferably provided.

The light-sensitive layer may further comprise, if desired, an anti-irradiation layer, a UV-absorbing layer, a protective layer, and the like.

F) Release Layer:

In the case of peel-apart type film units, a release layer can be provided so that the light-sensitive sheet may be peeled apart at any position thereof after processing. Accordingly, a release layer should be such that facilitates stripping after processing. Materials which can be used for such a release layer are described in JP-A-47-8237, JP-A-59-220727, JP-A-59-229555, JP-A-49-4653, U.S. Pat. Nos. 3,220,835 and 4,359,518, JP-A-49-4334, JP-A-56-65133, JP-A-45-24075, and U.S. Pat. Nos. 3,227,550, 2,759,825, 4,401,746, and 4,366,227. Specific examples of the materials include water-soluble (or alkali-soluble) cellulose derivatives, such as hydroxyethyl cellulose, cellulose acetate phthalate, plasticized methyl cellulose, ethyl cellulose, cellulose nitrate, and carboxymethyl cellulose; naturally-occurring high polymers, such as alginic acid, pectin, and gum arabic; various modified gelatin species, such as acetylated gelatin and phthalated gelatin; and water-soluble synthetic polymers, such as polyvinyl alcohol, polyacrylate, polymethyl methacrylate, polybutyl methacrylate, and copolymers thereof.

The release layer may have a single layer structure or, as described in JP-A-59-220727 or JP-A-60-60642, may have a multi-layered structure.

II. Cover Sheet:

In the present invention, a transparent cover sheet comprising a layer having a neutralizing function (i.e., a neutralizing layer and a neutralization timing layer) is used in order to spread a processing solution uniformly on a light-sensitive element and, at the same time, to neutralize the alkali after processing thereby stabilizing the image.

G) Support:

The support of the cover sheet may be any of smooth and transparent supports generally employed for photographic materials, such as cellulose acetate, polystyrene, polyethylene terephthalate, and polycarbonate. The support preferably has a subbing layer.

The support preferably contains a trace amount of a dye for prevention of light piping.

H) Layer with Neutralizing Function (Neutralizing Layer):

The layer having a neutralizing function is a layer containing a sufficient amount of an acidic substance for neutralizing the alkali carried over from the processing composition. If desired, the layer may have a multi-layered structure comprising a neutralization rate controlling layer (neutralization timing layer), a layer for assuring close contact with a light-sensitive element, and the like. The acidic substance is preferably a substance having an acidic group of pKa 9 or less (or a precursor group providing such an acidic group on hydrolysis). More preferred acidic substances include higher fatty acids, such as oleic acid, as described in U.S. Pat. No. 2,983,606; polymers of acrylic acid, methacrylic acid or maleic acid, or partial esters or acid anhydrides thereof as disclosed in U.S. Pat. No. 3,362,819; acrylic acid-acrylic ester copolymers as described in French Patent 2,290,699; and latex type acidic polymers as disclosed in U.S. Pat. No. 4,139,383 or *Research Disclosure* 16102 (1977).

In addition, the acidic substances described in U.S. Pat. No. 4,088,493, JP-A-52-153739, JP-A-53-1023, JP-A-53-4540, JP-A-53-4541, and JP-A-53-4542 are also useful.

Specific examples of the acidic polymers are copolymers of a vinyl monomer (e.g., ethylene, vinyl acetate or vinyl methyl ether) and maleic anhydride or an n-butyl ester thereof; butyl acrylate-acrylic acid copolymers; cellulose; and acetate hydrogenphthalate.

These acidic polymers may be used as mixed with a hydrophilic polymer, such as polyacrylamide, polymethyl pyrrolidone, polyvinyl alcohol (inclusive of partially saponified products), carboxymethyl cellulose, hydroxymethyl cellulose, hydroxyethyl cellulose, and polymethyl vinyl ether, with polyvinyl alcohol being preferred.

The acidic polymers may also be mixed with polymers other than hydrophilic ones, such as cellulose acetate.

The amount of the acidic polymer to be applied is decided by the amount of an alkali spread on the light-sensitive element. A suitable acidic polymer to alkali equivalent ratio per unit area ranges from 0.9 to 2.0, preferably from 1.0 to 1.3. Too small an amount of the acidic polymer tends to cause change in hue of a transferred dye or to stain the white background. Too large an amount also tends to result in change in hue or reduction in light-resistance.

The hydrophilic polymer used in combination also deteriorates the image quality if used in too large or too small an amount. A suitable weight ratio of hydrophilic polymer to acidic polymer is from 0.1 to 10, preferably 0.3 to 3.0.

The layer having a neutralizing function may contain additives for various purposes. For example, the layer may contain a hardening agent known to one skilled in the art or a polyhydroxy compound for improving brittleness, such as polyethylene glycol, polypropylene glycol or glycerin. Additionally, an antioxidant, a fluorescent whitening agent, a development inhibitor or a precursor thereof, and the like may also be incorporated into the layer according to necessity.

The neutralization timing layer to be combined with the neutralizing layer comprises, for example, polymers which reduce alkali permeability, such as gelatin, polyvinyl alcohol, a polyvinyl alcohol partial acetal, cellulose acetate, and a polyvinyl acetate partial hydrolysate; latex polymers which increase the energy required for activation of alkali permeation, such as those prepared by copolymerizing a small proportion of a hydrophilic comonomer (e.g., acrylic monomer); and polymers having a lactone ring.

Particularly useful among them are the timing layer using cellulose acetate disclosed in JP-A-54-136328 and U.S. Pat. Nos. 4,267,262, 4,009,030, and 4,029,849; the latex polymers prepared by copolymerizing a small proportion of a hydrophilic comonomer (e.g., acrylic acid) disclosed in JP-A-54-128335, JP-A-56-69629, JP-A-57-6843, and U.S. Pat. Nos. 4,056,394, 4,061,496, 4,199,362, 4,250,243, 4,256,827, and 4,268,604; the polymers having lactone ring disclosed in U.S. Pat. No. 4,229,516; and the polymers described in JP-A-56-25735, JP -A-56-97346, JP-A-57-6842, EP-A1-31957, EP-A1-37724, and EP -A1-48412.

In addition, materials described in U.S. Pat. Nos. 3,421,893, 3,455,686, 3,575,701, 3,778,265, 3,785,815, 3,847,615, 4,088,493, 4,123,275, 4,148,653, 4,201,587, 4,288,523, and 4,297,431, West German Patent Publication OLS Nos. 1,622,936 and 2,162,277, and *Research Disclosure* 15162, No. 151 (1976) are also useful.

The neutralization timing layer may have a single layer structure or a multi-layer structure composed of two or more layers.

It is possible to incorporate photographically useful additives (or precursors thereof) into the timing layer. Examples of the photographically useful additives include development inhibitors and/or precursors thereof disclosed in U.S. Pat. No. 4,009,029, West German Patent Publication OLS Nos. 2,913,164 and 3,014,672, JP-A-54-155837 and JP-A-55-138745 and hydroquinone precursors disclosed in U.S. Pat. No. 4,201,578.

For minimizing reduction of changes in transferred image density with time after processing, it is effective to provide an auxiliary neutralizing layer as a layer having a neutralization function as proposed in JP-A-63-168648 and JP-A-63-168649.

I) Other Layers:

In addition to the layer(s) having a neutralizing function, the cover sheet may further have auxiliary layers, such as a backing layer, a protective layer, and a filter dye layer.

The backing layer is for prevention of curling and for improving slip properties. A filter dye may be added to the backing layer.

The protective layer is chiefly for prevention of blocking to the back side of a cover sheet and for prevention of blocking to the protective layer of a light-sensitive material in case where a light-sensitive material and a cover sheet are laid one on another.

A dye may be added to a cover sheet for adjusting the sensitivity of a light-sensitive layer. A filter dye may either be added directly to the support of a cover sheet, a layer having a neutralizing function, or the aforesaid auxiliary layer (e.g., a backing layer, a protective layer or a capturing mordanted layer) or be provided as an independent layer.

The present invention will now be illustrated in greater detail with reference to Examples, but it should be understood that the present invention is not deemed to be limited thereto.

EXAMPLE 1

1) Preparation of Light-Sensitive Material:

A light-sensitive material was prepared by coating a 150 μm thick transparent polyethylene terephthalate film successively with coating compositions according to the layer structure shown in Table 1 below. The resulting light-sensitive material was designated sample 101. In the Table, the coating weights as for silver halide light-sensitive emulsions are given in terms of silver (g-Ag/m$^2$).

TABLE 1

| Layer No. | Function | Components | Coating Weight (g/m$^2$) |
|---|---|---|---|
| 21 | Protective | Gelatin | 1.00 |

TABLE 1-continued

| Layer No. | Function | Components | Coating Weight ($g/m^2$) |
|---|---|---|---|
| | layer | Matting agent (1) | 0.25 |
| 20 | UV absorbing layer | Gelatin | 0.50 |
| | | UV absorbent (1) | $4.0 \times 10^{-4}$ |
| | | UV absorbent (2) | $4.0 \times 10^{-4}$ |
| 19 | Yellow-sensitive layer (low-sensitive) | Internal latent image type direct positive emulsion (octahedral grains; grain size: 1.7 μm) | 0.48-Ag |
| | | Sensitizing dye (3) | $1.4 \times 10^{-3}$ |
| | | Nucleating agent (1) | $6.8 \times 10^{-8}$ |
| | | Additive (2) | 0.03 |
| | | Gelatin | 0.70 |
| 18 | Yellow-sensitive layer (high-sensitive) | Internal latent image type direct positive emulsion (octahedral grains; grain size: 1.1 μm) | 0.20-Ag |
| | | Sensitizing dye (3) | $9.0 \times 10^{-4}$ |
| | | Nucleating agent (1) | $8.0 \times 10^{-8}$ |
| | | Additive (2) | $4.5 \times 10^{-2}$ |
| | | Gelatin | 0.40 |
| 17 | White reflecting layer | Titanium dioxide | 0.70 |
| | | Gelatin | 0.18 |
| 16 | Yellow dye layer | Yellow dye-releasing compound (1) | 0.53 |
| | | High-boiling organic solvent (1) | 0.13 |
| | | Additive (1) | $1.4 \times 10^{-2}$ |
| | | Gelatin | 0.70 |
| 15 | Intermediate layer | Gelatin | 0.30 |
| 14 | Color mixing preventive layer | Additive (1) | 0.80 |
| | | Polymethyl methacrylate | 0.80 |
| | | Gelatin | 0.45 |
| 13 | Green-sensitive layer (high- | Internal latent image type direct positive emulsion (octahedral grains; grain size: 1.6 μm) | 0.64-Ag |
| | | Sensitizing dye (2) | $2.1 \times 10^{-3}$ |
| | | Nucleating agent (1) | $2.5 \times 10^{-8}$ |
| | | Additive (2) | 0.08 |
| | | Gelatin | 1.00 |
| 12 | Green-sensitive layer (low-sensitive) | Internal latent image type direct positive emulsion (octahedral grains; grain size: 1.0 μm) | 0.20-Ag |
| | | Sensitizing dye (2) | $1.1 \times 10^{-3}$ |
| | | Nucleating agent (1) | $4.4 \times 10^{-8}$ |
| | | Additive (2) | 0.03 |
| | | Gelatin | 0.50 |
| 11 | White reflecting layer | Titanium dioxide | 1.00 |
| | | Gelatin | 0.25 |
| 10 | Magenta dye layer | Magenta dye-releasing compound (1) | 0.50 |
| | | High-boiling organic solvent (1) | 0.10 |
| | | Additive (1) | $9.0 \times 10^{-3}$ |
| | | Gelatin | 0.90 |
| 9 | Intermediate layer | Gelatin | 0.30 |
| 8 | Color mixing layer | Additive (1) | 1.20 |
| | | Polymethyl methacrylate | 1.20 |
| | | Gelatin | 0.70 |
| 7 | Red-sensitive layer (high-sensitive) | Internal latent image type direct positive emulsion (octahedral grain; grain size: 1.6 μm) | 0.40-Ag |
| | | Sensitizing dye (1) | $6.2 \times 10^{-4}$ |
| | | Nucleating agent (1) | $5.0 \times 10^{-8}$ |
| | | Additive (2) | 0.04 |
| | | Gelatin | 1.80 |
| 6 | Red-sensitive layer (low-sensitive) | Internal latent image type direct positive emulsion (octahedral grains; grain size: 1.0 μm) | 0.12-Ag |
| | | Sensitizing dye (1) | $3.0 \times 10^{-4}$ |
| | | Nucleating agent (1) | $5.0 \times 10^{-8}$ |
| | | Additive (2) | 0.02 |
| | | Gelatin | 0.40 |
| 5 | White | Titanium dioxide | 3.00 |

TABLE 1-continued

| Layer No. | Function | Components | Coating Weight ($g/m^2$) |
|---|---|---|---|
| | reflecting layer | Gelatin | 0.80 |
| 4 | Cyan dye layer | Cyan dye-releasing compound (1) | 0.50 |
| | | High-boiling organic solvent (1) | 0.10 |
| | | Additive (1) | 0.10 |
| | | Gelatin | 1.0 |
| 3 | Light-shielding layer | Carbon black | 1.70 |
| | | Gelatin | 1.70 |
| 2 | White reflecting layer | Titanium dioxide | 22.00 |
| | | Gelatin | 2.75 |
| 1 | Image-receiving layer | Polymer mordant (1) | 3.00 |
| | | Gelatin | 3.00 |
| Support | | Polyethylene terephthalate (thickness: 150 μm) | |

Polymer Mordant (1):

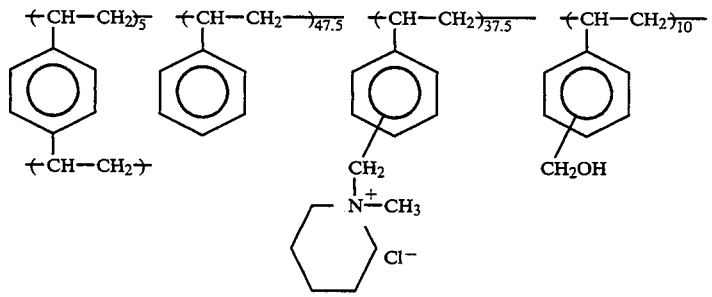

UV Absorbent (1):

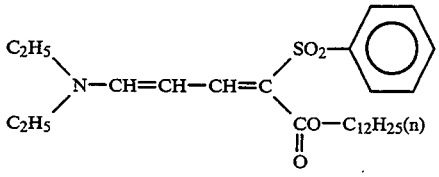

UV Absorbent (2):

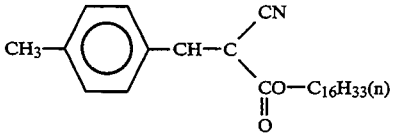

Matting Agent (1):

Polymethyl methacrylate latex (sperical particles ; average size: 4 μm)

Cyan Dye-Releasing Compound (1):

-continued
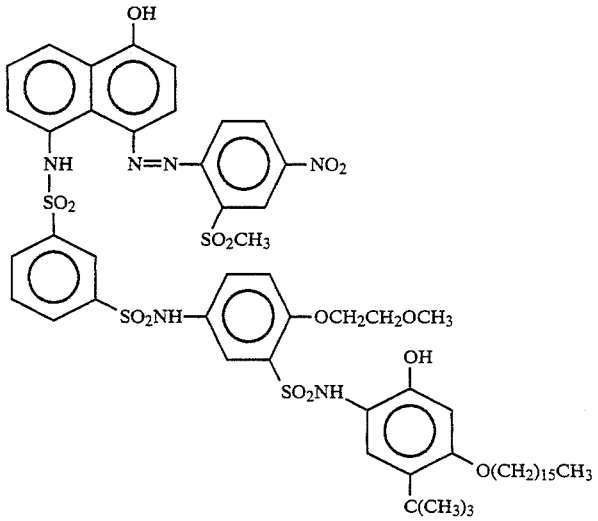
Magenta Dye-Releasing Compound (1):
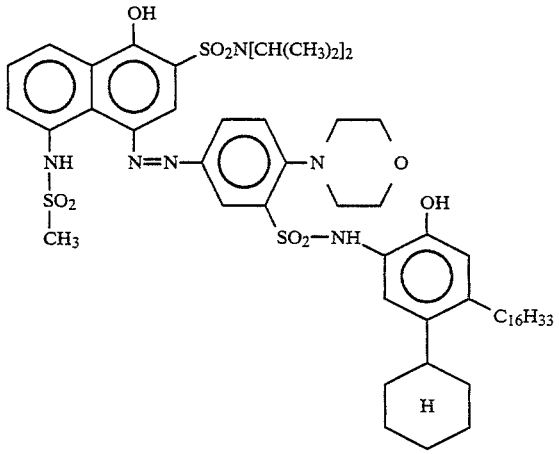
Yellow Dye-Releasing Compound (1):
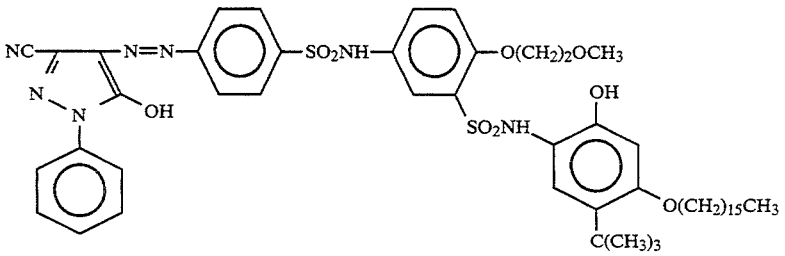
Additive (1):
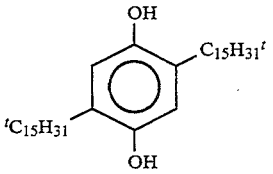
Additive (2):

-continued

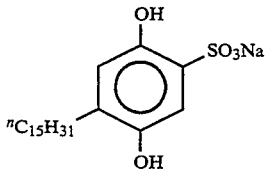

High-Boiling Organic Solvent (1):

Tricresyl phosphate

Nucleating Agent (1):

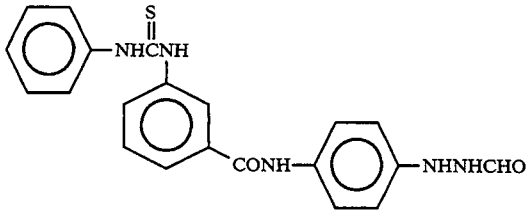

Sensitizing Dye (1):

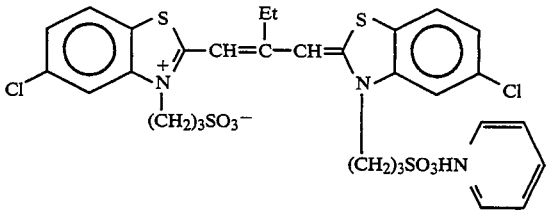

Sensitizing Dye (2):

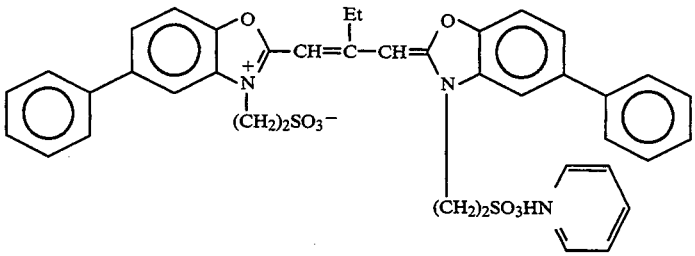

Sensitizing Dye (3):

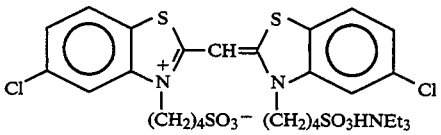

Light-sensitive materials (designated samples 102, 103, 105 to 114) were prepared in the same manner as for sample 101, except that a layer consisting of 1.0 g/m$^2$ of the compound of formula (II) shown in Table 2 and 1.0 g/m$^2$ of gelatin was provided between layers 20 and 21 of Table 1 and/or the compound of formula (I) shown in Table 2 was added to each dye layer (layers 4, 10 and 16) in an amount equimolar to the respective dye-releasing compound.

2) Preparation of Cover Sheet:

A polyethylene terephthalate transparent film containing therein a dye for preventing light piping and having thereon a gelatin subbing layer was coated with layers (1) to (3) shown below in the order listed to obtain a cover sheet.

(1) A neutralizing layer consisting of 10.4 g/m$^2$ of an acrylic acid/butyl acrylate (8:2 by mole) copolymer having an average molecular weight of 50,000 and 0.1 g/m$^2$of 1,4-bis(2,3-epoxypropoxy)butane.

(2) A neutralization timing layer consisting of 4.3 g/m$^2$ of acetyl cellulose having a degree of acetylation of 51% and 0.2 g/m$^2$ of poly(methyl vinyl ether-monomethyl maleate).

(3) A layer consisting of 1.0 g/m$^2$ (on a solid basis) of a 6:4 (on a solid basis) mixture of an emulsion polymer latex of styrene/butyl acrylate/acrylic acid/N-methylolacrylamide (49.7/42.3/4/4 by weight) and an emulsion polymer latex of methyl methacrylate/acrylic acid/N-methylolacrylamide (93/3/4 by weight).

3) Preparation of Processing Composition:

An alkali processing composition was prepared according to the following formulation and packed in containers destroyable by pressure by 0.8 g portions. The resulting processing composition is for development of samples 101 to 103 and 105 to 111.

| Formulation of Processing Composition: | |
|---|---|
| 1-p-Tolyl-4-hydroxymethyl-4-methyl-3-pyrazolidone | 10.0 g |
| Methylhydroquinone | 0.18 g |
| 5-Methylbenzotriazole | 3.0 g |
| Sodium sulfite (anhydrous) | 0.2 g |
| Benzyl alcohol | 1.5 cc |
| Sodium carboxymethyl cellulose | 58 g |
| Carbon black | 150 g |
| Potassium hydroxide (28% aqueous solution) | 200 cc |
| Water | 680 cc |

Alkali processing solutions were prepared in the same manner as described above, except that the formulation further contained the compound of formula (V) as shown in Table 2 in an amount corresponding to 3 mmol/m$^2$ in terms of amine site after being spread on the light-sensitive element. These processing compositions are for development of samples 104 and 112 to 114.

3) Development and Evaluation:

The light-sensitive element (samples 101 to 114) was exposed to light from the emulsion layer side through a gray filter, and the cover sheet was superposed thereon. The processing composition was spread between the light-sensitive element and the cover sheet to a thickness of 75 μm at 25° C. by means of a pressure roll.

After 1 day from the spreading, the maximum density $D_{max}$ (reflection density) was measured with Fuji System Densitometer (FSD). Then, the film unit was allowed to stand at 40° C. and 80% RH for 7 days, and the maximum density was again measured.

The minimum cyan density $D_{min}$ after the processing was similarly measured. Then, the film unit was allowed to stand at 60° C. and 70% RH for 3 weeks, and the minimum density was again measured to examine any increase ($\Delta D_{R:min}$).

Further, the sharpness of the image was evaluated in terms of spatial frequency (cycle/mm) which gives a contract transfer function (C.T.F) of 0.5 lines/mm.

The results obtained are shown in Table 2.

TABLE 2

| Sample No. | Compound (I) | Compound (II)/(V) Compound | Place of Addition* | $D_{max}$ After 1 Day B | G | R | $D_{max}$ After 7 Dys (40°,80% RH) B | G | R | Cyan Stain $\Delta D_{R:min}$ | C.T.F. lines/mm (Magenta) | Remark |
|---|---|---|---|---|---|---|---|---|---|---|---|---|
| 101 | — | — | — | 1.60 | 1.71 | 2.01 | 1.70 | 2.11 | 2.20 | 0.20 | 2.62 | Comparison |
| 102 | I-12 | — | — | 1.92 | 2.04 | 2.32 | 2.12 | 2.54 | 2.64 | 0.35 | 2.49 | " |
| 103 | — | II-6 | L | 1.50 | 1.51 | 1.82 | 1.58 | 1.71 | 1.92 | 0.20 | 2.61 | " |
| 104 | — | V-18 | P | 1.55 | 1.61 | 1.91 | 1.58 | 1.70 | 1.99 | 0.20 | 2.62 | " |
| 105 | I-12 | II-6 | L | 1.81 | 2.00 | 2.31 | 1.83 | 2.10 | 2.39 | 0.20 | 2.62 | Invention |
| 106 | I-1 | V-10 | " | 1.82 | 2.02 | 2.29 | 1.83 | 2.11 | 2.34 | 0.19 | 2.63 | " |
| 107 | I-3 | II-27 | " | 1.80 | 2.01 | 2.22 | 1.84 | 2.13 | 2.34 | 0.20 | 2.64 | " |
| 108 | I-18 | II-9 | " | 1.81 | 2.04 | 2.28 | 1.86 | 2.14 | 2.34 | 0.20 | 2.63 | " |
| 109 | I-7 | II-12 | " | 1.83 | 2.02 | 2.26 | 1.87 | 2.16 | 2.38 | 0.20 | 2.64 | " |
| 110 | I-19 | II-18 | " | 1.84 | 2.00 | 2.28 | 1.88 | 2.14 | 2.30 | 0.19 | 2.63 | " |
| 111 | I-37 | II-22 | " | 1.83 | 2.01 | 2.27 | 1.89 | 2.14 | 2.31 | 0.20 | 2.63 | " |
| 112 | I-38 | V-18 | P | 1.84 | 2.06 | 2.32 | 1.89 | 2.17 | 2.39 | 0.19 | 2.63 | " |
| 113 | I-12 | V-23 | " | 1.83 | 2.04 | 2.29 | 1.86 | 2.18 | 2.39 | 0.20 | 2.62 | " |
| 114 | I-12 | V-15 | " | 1.82 | 2.04 | 2.26 | 1.84 | 2.26 | 2.42 | 0.19 | 2.62 | " |

Note*: L; Light-sensitive material; P: Processing composition

As is apparent from Table 2, where the compound of formula (I) is used alone, the transferred image, though having a high density, undergoes great changes in density with time and deterioration in minimum cyan density and sharpness with time. To the contrary, where it is used in combination with the compound of formula (II) or (III), these disadvantages were eliminated while retaining the high transferred image density.

EXAMPLE 2

1) Preparation of Light-Sensitive Element:

A light-sensitive material (designated sample 201) was prepared by coating a polyethylene terephthalate transparent support with the following layers.

Backing Layer:

A light-shielding layer consisting of 4.0 g/m$^2$ of carbon black and 2.0 g/m$^2$ of gelatin.

Emulsion Layers:

(1) A layer containing 0.44 g/m$^2$ of a cyan dye-releasing redox compound of formula:

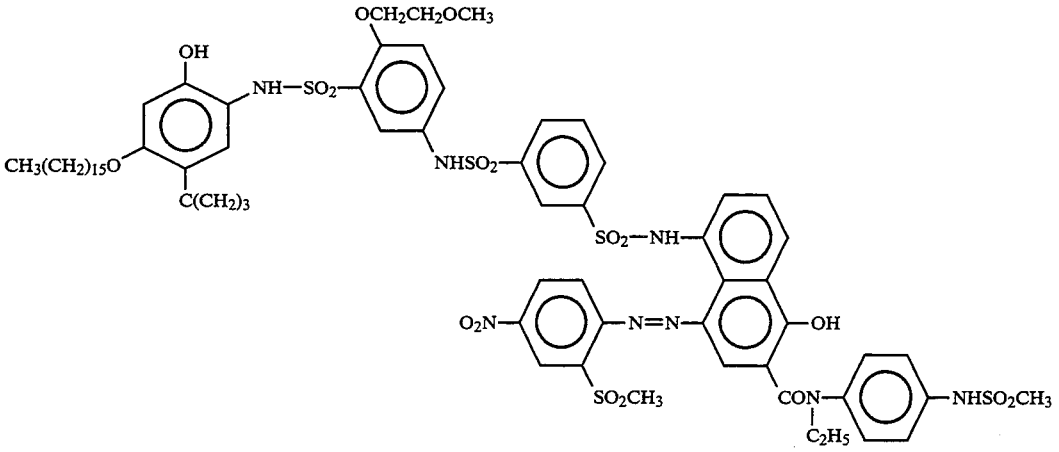

0.09 g/m$^2$ of tricyclohexyl phosphate, 0.008 g/m$^2$ of 2,5-di-t-pentadecylhydroquinone, and 0.8 g/m$^2$ of gelatin.

(2) A layer containing 0.5 g/m$^2$ of gelatin.

(3) A red-sensitive emulsion layer containing 0.48 g-Ag/m$^2$ of a red-sensitive internal latent image type direct positive silver bromide emulsion, 1.2 g/m$^2$ of gelatin, 0.015 g/m$^2$ of a nucleating agent of formula:

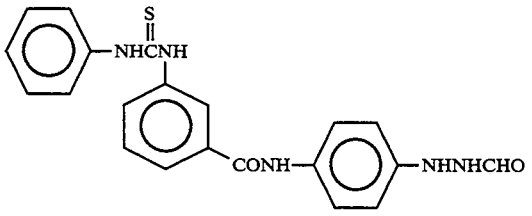

and 0.06 g/m$^2$ of sodium 2-sulfo-5-n-pentadecylhydroquinone.

(4) A layer containing 0.43 g/m$^2$ of 2,5-di-t-pentadecylhydroquinone, 0.1 g/m$^2$ of trihexyl phosphate, and 0.4 g/m$^2$ of gelatin.

(5) A layer containing 0.3 g/m$^2$ of a magenta dye-releasing redox compound of formula:

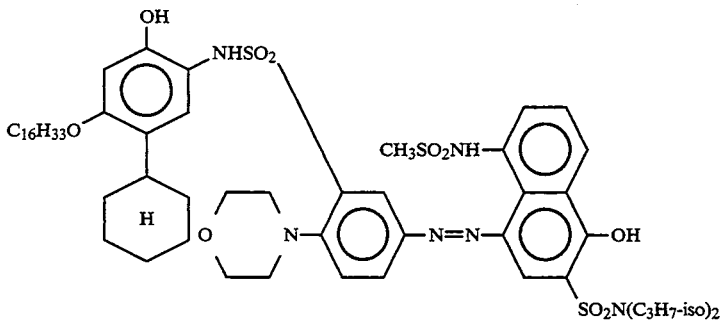

0.08 g/m$^2$ of tricyclohexyl phosphate, 0.009 g/m$^2$ of 2,5-di-t-pentadecylhydroquinone, and 0.5 g/m$^2$ of gelatin.

(6) A green-sensitive emulsion layer containing 0.33 g-Ag/m$^2$ of a green-sensitive internal latent image type direct positive silver bromide emulsion, 0.9 g/m$^2$ of gelatin, 0.013 g/m$^2$ of the same nucleating agent as used in layer (3), and 0.07 g/m$^2$ of sodium 2-sulfo-5-n-pentadecylhydroquinone.

(7) The same layer as layer (4).

(8) A layer containing 0.53 g/m$^2$ of a yellow dye-releasing redox compound of formula:

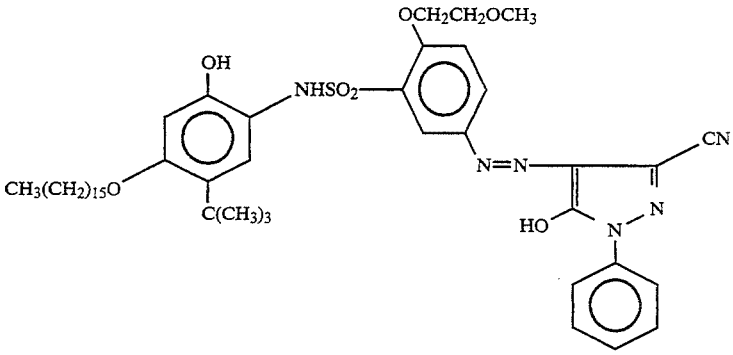

0.13 g/m$^2$ of tricyclohexyl phosphate, 0.014 g/m$^2$ of 2,5-di-t-pentadecylhydroquinone, and 0.7 g/m$^2$ of gelatin.

(9) A blue-sensitive emulsion layer containing 0.48 g-Ag/m$^2$ of a blue-sensitive internal latent image type direct positive silver bromide emulsion, 1.1 g/m$^2$ of gelatin, 0.019 g/m$^2$ of the same nucleating agent as used in layer (3), and 0.05 g/m$^2$ of sodium 2-sulfo-5-n-pentadecylhydroquinone.

(10) A layer containing 1.0 g/m$^2$ of gelatin.

Light-sensitive materials (designated samples 202 to 214) were prepared in the same manner as for sample 201, except that each dye-releasing layer (layers (1), (5) and (8)) further contained the compound of formula (I) shown in Table 4 in an amount equimolar to the respective dye-releasing compound.

2) Preparation of Image-Receiving Sheet (dye fixing element):

An image-receiving sheet having the layer structure shown in Table 3 was prepared.

TABLE 3

| Layer No. | Layer Function | Component | Coating Weight (g/m$^2$) |
|---|---|---|---|
| F6 | Protective layer | Gelatin | 0.6 |
| F5 | Mordanted layer | Gelatin | 3.0 |
| | | Mordant (A) | 3.0 |
| | | Coating aid (B) | 0.5 |
| F4 | Timing layer (1) | Polymer latex (1) | 0.96 |
| | | Polymer latex (2) | 0.64 |
| F3 | Intermediate layer | Poly(2-hydroxyethyl methacrylate) | 0.4 |
| F2 | Timing layer (2) | Cellulose acetate (degree of acetylation: 51.3%) | 4.27 |
| | | Styrene/maleic anhydride (1:1 by mole) copolymer (average molecular weight: 10,000) | 0.23 |
| F1 | Neutralizing layer | Acrylic acid/butyl acrylate (8:2 by mole) copolymer (average molecular weight: 50,000) | 22 |
| Support | | Paper having a 30 μm thick polyethylene layer on each side (total thickness: 150 μm) | |
| B1 | Light-shielding layer | Gelatin | 2.0 |
| | | Carbon black | 4.0 |
| B2 | White reflecting layer | Gelatin | 1.0 |
| | | Titanium oxide | 8.0 |
| B3 | Protective layer | Gelatin | 0.6 |

Mordant (A):

TABLE 3-continued

| Layer No. | Layer Function | Component | Coating Weight (g/m$^2$) |
|---|---|---|---|

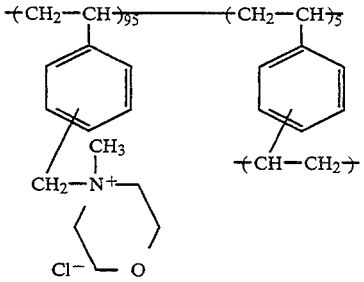

Coating Aid (B):

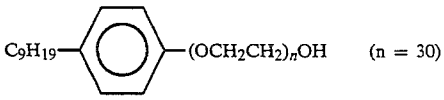

Polymer latex (1):
Styrene/butyl acrylate/acrylic acid/N-methylolacrylamide (49.7/42.3/4/4 by weight) copolymer
Polymer latex (2):
Methyl methacrylate/acrylic acid/N-methylolacrylamide (93/3/4 by weight) copolymer (3) Processing Solution:

A processing composition having the following formulation was prepared.

| Processing Composition Formulation: | |
|---|---|
| 1-p-Tolyl-4-hydroxymethyl-4-methyl-3-pyrazolidone | 6.9 g |
| Methylhydroquinone | 0.3 g |
| 5-Methylbenzotriazole | 3.5 g |
| Sodium sulfite (anhydrous) | 0.2 g |
| Sodium carboxymethyl cellulose | 58 g |
| Potassium hydroxide (28% aqueous solution) | 200 cc |
| Benzyl alcohol | 1.5 cc |
| Water | 835 cc |

Another processing composition was prepared in the same manner as described above, except that the compound of formula (III) shown in Table 4 was further added in an amount corresponding to 3 mmol/m$^2$ in terms of amine site after being spread in a film unit.

4) Development and Evaluation:

The light-sensitive sheet was imagewise exposed to light, and the image-receiving sheet was brought into contact therewith. The processing composition was spread therebetween to a thickness of 60 μm at 25° C.

After 60 seconds' or 180 seconds' contact, the image-receiving sheet was peeled apart. The maximum density ($D_{max}$) and the minimum density ($D_{min}$) were measured to obtain a difference between the peeling after 60 seconds and the peeling after 180 seconds. Further, the image-receiving sheet separated after 60 seconds' contact was allowed to stand at 60° C. and 70% RH for 30 days to measure a reduction in magenta reflection density. The results obtained are shown in Tables 4-A and 4-B.

TABLE 4-A

| Sample No. | Compound (I) | Compound (V) | Processing Time: 60 sec. $D_{min}$ B | G | R | $D_{max}$ B | G | R | Increase in Density (60° C.,70% x 30 Dys) ($^{\Delta}D_G$) | Remark |
|---|---|---|---|---|---|---|---|---|---|---|
| 201 | — | — | 0.16 | 0.20 | 0.18 | 1.49 | 1.71 | 2.24 | 0.24 | Comparison |
| 202 | I-12 | V-18 | 0.17 | 0.21 | 0.18 | 1.81 | 2.20 | 2.69 | 0.31 | " |
| 203 | I-1 | V-18 | 0.16 | 0.20 | 0.18 | 1.81 | 2.21 | 2.70 | 0.18 | Invention |
| 204 | I-3 | V-18 | 0.15 | 0.20 | 0.18 | 1.81 | 2.21 | 2.71 | 0.17 | " |
| 205 | I-7 | V-18 | 0.16 | 0.20 | 0.18 | 1.80 | 2.19 | 2.68 | 0.16 | " |
| 206 | I-12 | V-18 | 0.16 | 0.20 | 0.18 | 1.82 | 2.19 | 2.70 | 0.18 | " |
| 207 | I-18 | V-18 | 0.15 | 0.20 | 0.18 | 1.80 | 2.18 | 2.69 | 0.16 | " |
| 208 | I-19 | V-18 | 0.16 | 0.20 | 0.18 | 1.81 | 2.21 | 2.71 | 0.18 | " |
| 209 | I-37 | V-18 | 0.16 | 0.20 | 0.18 | 1.82 | 2.19 | 2.72 | 0.16 | " |
| 210 | I-38 | V-18 | 0.16 | 0.20 | 0.18 | 1.81 | 2.22 | 2.78 | 0.16 | " |
| 211 | I-12 | V-3 | 0.15 | 0.20 | 0.17 | 1.80 | 2.18 | 2.69 | 0.17 | " |
| 212 | I-12 | V-10 | 0.16 | 0.20 | 0.18 | 1.83 | 2.21 | 2.70 | 0.18 | " |
| 213 | I-12 | V-15 | 0.16 | 0.19 | 0.18 | 1.82 | 2.22 | 2.74 | 0.17 | " |
| 214 | I-12 | V-20 | 0.15 | 0.20 | 0.18 | 1.81 | 2.21 | 2.70 | 0.17 | " |

TABLE 4-B

| Sample No. | Compound (I) | Compound (V) | Processing Time: 120 sec. $D_{min}$ B | G | R | $D_{max}$ B | G | R | Increase in Density (60° C., 70% x 30 Dys) ($^{\Delta}D_G$) | Remark |
|---|---|---|---|---|---|---|---|---|---|---|
| 201 | — | — | 0.24 | 0.30 | 0.24 | 1.69 | 2.01 | 2.34 | 0.34 | Comparison |
| 202 | I-12 | — | 0.30 | 0.35 | 0.31 | 2.11 | 2.60 | 2.89 | 0.44 | " |
| 203 | I-1 | V-18 | 0.16 | 0.20 | 0.18 | 1.82 | 2.23 | 2.72 | 0.18 | Invention |
| 204 | I-3 | V-18 | 0.15 | 0.21 | 0.19 | 1.83 | 2.24 | 2.73 | 0.17 | " |
| 205 | I-7 | V-18 | 0.16 | 0.20 | 0.19 | 1.82 | 2.23 | 2.72 | 0,16 | " |
| 206 | I-12 | V-18 | 0.17 | 0.21 | 0.18 | 1.86 | 2.23 | 2.74 | 0.18 | " |
| 207 | I-18 | V-18 | 0.16 | 0.21 | 0.19 | 1.84 | 2.23 | 2.73 | 0.16 | " |
| 208 | I-19 | V-18 | 0.15 | 0.21 | 0.21 | 1.85 | 2.24 | 2.75 | 0.17 | " |
| 209 | I-37 | V-18 | 0.16 | 0.20 | 0.18 | 1.85 | 2.23 | 2.76 | 0.16 | " |
| 210 | I-38 | V-18 | 0.16 | 0.22 | 0.18 | 1.84 | 2.26 | 2.81 | 0.16 | " |
| 211 | I-12 | V-3 | 0.15 | 0.19 | 0.18 | 1.84 | 2.26 | 2.73 | 0.17 | " |
| 212 | I-12 | V-10 | 0.16 | 0.18 | 0.17 | 1.85 | 2.26 | 2.72 | 0.18 | " |
| 213 | I-12 | V-15 | 0.16 | 0.18 | 0.17 | 1.83 | 2.24 | 2.76 | 0.17 | " |
| 214 | I-12 | V-20 | 0.16 | 0.18 | 0.18 | 1.84 | 2.24 | 2.79 | 0.17 | " |

It is seen from Tables 4-A and B that the compound of formula (I) combined with the compound of formula (V) remarkably reduces the dependency of $D_{max}$ and $D_{min}$ on the timing of peeling (processing time) and suppresses the magenta density change with time.

EXAMPLE 3

1) Preparation of Light-Sensitive Element:

A light-sensitive element having the layer structure shown in Table 5 was prepared. The resulting element was designated K-1. In the Table, the coating weights as for silver halide light-sensitive emulsions are given in terms of silver (g-Ag/m$^2$).

TABLE 5

| Layer No. | Function | Components | Coating Weight (g/m$^2$) |
|---|---|---|---|
| 21 | Protective layer | Gelatin | 0.40 |
| | | Matting agent. | 0.25 |
| 20 | UV absorbing layer | Gelatin | 0.50 |
| | | UV absorbent (1) | $4.0 \times 10^{-4}$ |
| | | UV absorbent (2) | $4.0 \times 10^{-4}$ |
| 19 | Yellow-sensitive layer (high-sensitive) | Internal latent image type direct positive emulsion (octahedral grains; grain size: 1.7 μm) | 0.60-Ag |
| | | Sensitizing dye (3) | $1.4 \times 10^{-3}$ |
| | | Nucleating agent (1) | $6.8 \times 10^{-8}$ |
| | | Additive (2) | 0.03 |
| | | Gelatin | 0.70 |
| 18 | Yellow-sensitive layer | Internal latent image type direct positive emulsion (octahedral grains; grain | 0.25-Ag |

TABLE 5-continued

| Layer No. | Function | Components | Coating Weight ($g/m^2$) |
|---|---|---|---|
| | (low-sensitive) | size: 1.1 μm) | |
| | | Sensitizing dye (3) | $9.0 \times 10^{-4}$ |
| | | Nucleating agent (1) | $8.0 \times 10^{-8}$ |
| | | Additive (2) | $4.5 \times 10^{-2}$ |
| | | Gelatin | 0.40 |
| 17 | White reflecting layer | Titanium dioxide | 0.70 |
| | | Gelatin | 0.18 |
| 16 | Yellow dye layer | Yellow dye-releasing compound (1) | 0.53 |
| | | High-boiling organic solvent (1) | 0.13 |
| | | Additive (1) | $1.4 \times 10^{-2}$ |
| | | Gelatin | 0.70 |
| 15 | Intermediate layer | Gelatin | 0.30 |
| 14 | Color mixing preventive layer | Additive (1) | 0.80 |
| | | Polymethyl methacrylate | 0.80 |
| | | Gelatin | 0.45 |
| 13 | Green-sensitive layer (high-sensitive | Internal latent image type direct positive emulsion (octahedral grains; grain size: 1.6 μm) | 0.80-Ag |
| | | Sensitizing dye (2) | $2.1 \times 10^{-3}$ |
| | | Nucleating agent (1) | $2.5 \times 10^{-8}$ |
| | | Additive (2) | 0.08 |
| | | Gelatin | 1.00 |
| 12 | Green-sensitive layer (low-sensitive) | Internal latent image type direct positive emulsion (octahedral grains; grain size: 1.0 μm) | 0.25-Ag |
| | | Sensitizing dye (2) | $1.1 \times 10^{-3}$ |
| | | Nucleating agent (1) | $4.4 \times 10^{-8}$ |
| | | Additive (2) | 0.03 |
| | | Gelatin | 0.50 |
| 11 | White reflecting layer | Titanium dioxide | 1.00 |
| | | Gelatin | 0.25 |
| 10 | Magenta dye layer | Magenta dye-releasing compound (1) | 0.50 |
| | | High-boiling organic solvent (1) | 0.10 |
| | | Additive (1) | $9.0 \times 10^{-3}$ |
| | | Gelatin | 0.40 |
| 9 | Intermediate layer | Gelatin | 0.30 |
| 8 | Color mixing preventive layer | Additive (1) | 1.20 |
| | | Polymethyl methacrylate | 1.20 |
| | | Gelatin | 0.70 |
| 7 | Red-sensitive layer (high-sensitive) | Internal latent image type direct positive emulsion (octahedral grain; grain size: 1.6 μm) | 0.50-Ag |
| | | Sensitizing dye (1) | $6.2 \times 10^{-4}$ |
| | | Nucleating agent (1) | $5.0 \times 10^{-8}$ |
| | | Additive (2) | 0.04 |
| | | Gelatin | 1.80 |
| 6 | Red-sensitive layer (low-sensitive) | Internal latent image type direct positive emulsion (octahedral grains; grain size: 1.0 μm) | 0.15-Ag |
| | | Sensitizing dye (1) | $3.0 \times 10^{-4}$ |
| | | Nucleating agent (1) | $5.0 \times 10^{-8}$ |
| | | Additive (2) | 0.02 |
| | | Gelatin | 0.40 |
| 5 | White reflecting layer | Titanium dioxide | 3.00 |
| | | Gelatin | 0.80 |
| 4 | Cyan dye layer | Cyan dye-releasing compound (1) | 0.50 |
| | | High-boiling organic solvent (1) | 0.10 |
| | | Additive (1) | 0.01 |
| | | Gelatin | 0.40 |
| 3 | Light-shielding layer | Carbon black | 1.70 |
| | | Gelatin | 1.20 |
| 2 | White reflecting layer | Titanium dioxide | 19.00 |
| | | Gelatin | 2.00 |

TABLE 5-continued

| Layer No. | Function | Components | Coating Weight ($g/m^2$) |
|---|---|---|---|
| 1 | Image-receiving layer | Polymer mordant (1)<br>Gelatin | 3.20<br>3.00 |
| Support | | Polyethylene terephthalate (thickness: 90 μm) | |

The compounds used in light-sensitive element K-1 were as follows.

Polymer Mordant (1):

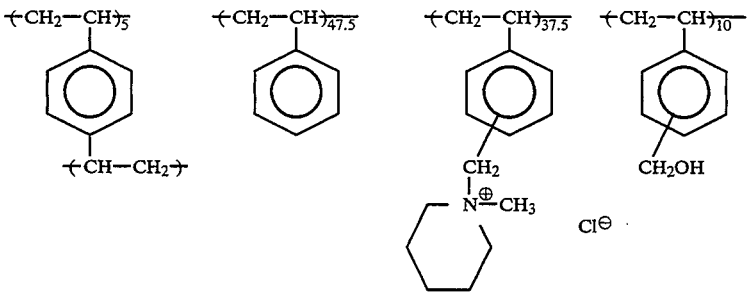

UV Absorbent (1):

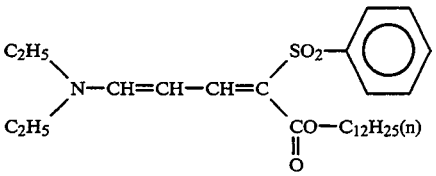

UV Absorbent (2):

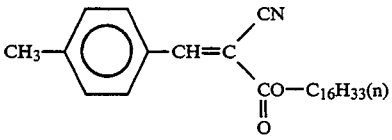

Matting Agent (1):
Polymethyl methacrylate latex (spherical particles; average particle size: 4 μm)

Cyan Dye-Releasing Compound (1):

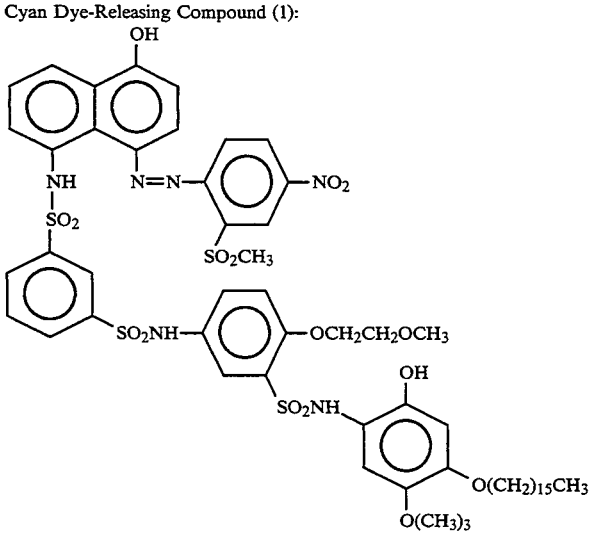

Magenta Dye-Releasing Compound (1):

-continued
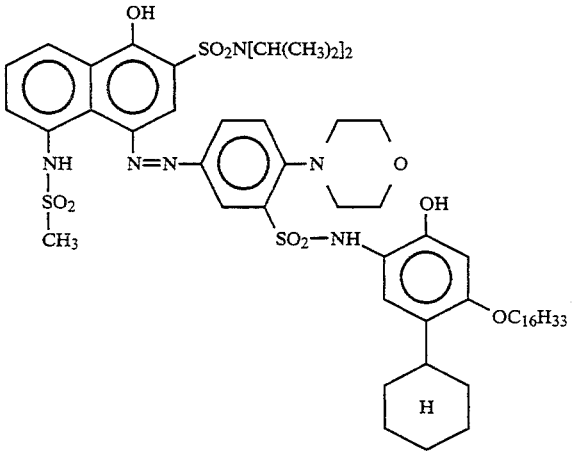
Yellow Dye-Releasing Compound (1):
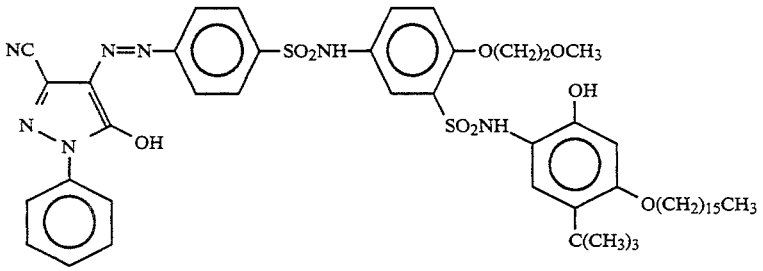
Additive (1):
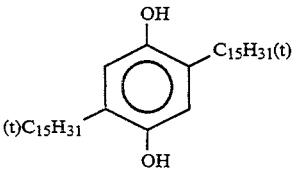
Additive (2):
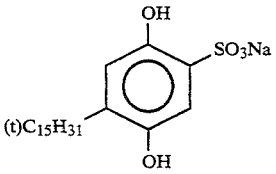
High-Boiling Organic Solvent (1):
Tricresyl phosphate
Nucleating Agent (1):
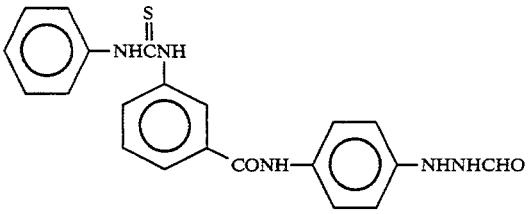
Sensitizing Dye (1):

-continued

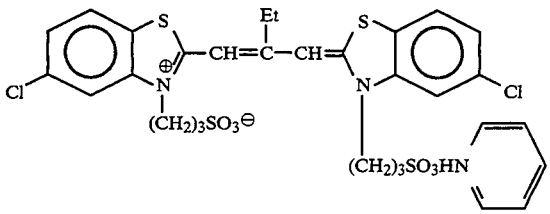

Sensitizing Dye (2):

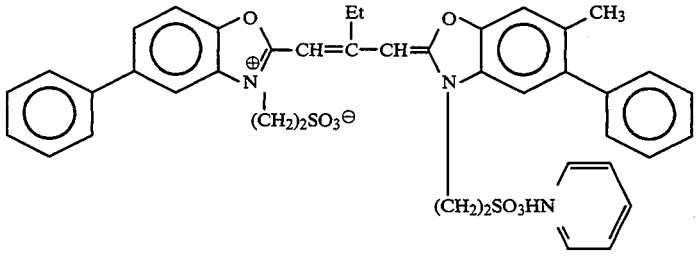

Sensitizing Dye (3):

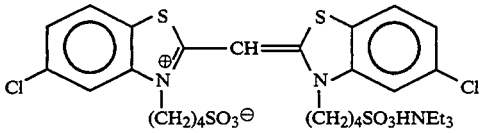

Light-sensitive element K-2 was prepared in the same manner as for K-1, except that a layer consisting of 70 mmol/m$^2$, in terms of tertiary amine site, of tertiary amine polymer (20) and 1 g/m$^2$ of gelatin was provided between layers 20 and 21 of Table 5.

2) Preparation of Cover Sheet:

A polyethylene terephthalate transparent film containing therein a dye for preventing light piping and having thereon a gelatin subbing layer was coated with layers (1) to (3) shown below in the order listed to obtain a cover sheet. The resulting cover sheet was designated C-1.

(1) A neutralizing layer consisting of 10.4 g/m$^2$ of an acrylic acid/butyl acrylate (8:2 by mole) copolymer having an average molecular weight of 50,000 and 0.1 g/m$^2$ of 1,4-bis(2,3-epoxypropoxy)butane.

(2) A neutralization timing layer consisting of 4.3 g/m$^2$ of acetyl cellulose having a degree of acetylation of 51% and 0.2 g/m$^2$ of poly(methyl vinyl ether-monomethyl maleate).

(3) A layer consisting of 1.0 g/m$^2$ (on a solid basis) of a 6:4 (on a solid basis) mixture of an emulsion polymer latex of styrene/butyl acrylate/acrylic acid/N-methylolacrylamide (49.7/42.3/4/4 by weight) and an emulsion polymer latex of methyl methacrylate/acrylic acid/N-methylolacrylamide (93/3/4 by weight).

Cover sheet C-2 was prepared in the same manner as in for C-1, except that a layer containing 7 mmol/m$^2$, in terms of tertiary amine site, of polymer 20 and 1 g/m$^2$ of gelatin was further provided on layer (3).

3) Preparation of Processing Composition:

An alkali processing composition (designated P-1) was prepared according to the following formulation and packed in containers destroyable by pressure by 0.8 g portions.

| Formulation of Processing Composition: | |
|---|---|
| 1-p-Tolyl-4-hydroxymethyl-4-methyl-3-pyrazolidone | 10.0 g |
| Methylhydroquinone | 0.18 g |
| 5-Methylbenzotriazole | 3.0 g |
| Sodium sulfite | 0.2 g |
| Benzyl alcohol | 1.5 cc |
| Sodium carboxymethyl cellulose | 58 g |
| Carbon black | 150 g |
| Potassium hydroxide (28% aqueous solution) | 200 cc |
| Water | 680 cc |

Another alkali processing composition (designated P-2) was prepared in the same manner as for P-1, except that the formulation further contained tertiary amine polymer (20) in an amount corresponding to 7 mmol/m$^2$ in terms of amine site when spread on the light-sensitive element by means of a pressure roll to a thickness of 75 μm as hereinafter described.

3) Development and Evaluation:

The above-prepared light-sensitive elements, cover sheets, and processing compositions were combined to prepare two sets of film units, shown below, which were loadable in a camera.

Film unit 301: K-2/C-1/P-1 (comparison)

Film unit 302: K-1/C-2/P-1 (comparison)

Film unit 303: K-1/C-1/P-2 (invention)

One set of film units 301 to 303 was preserved at room temperature, while the other set was preserved at 45° C. and 70% RH for 7 days (accelerated aging).

The film unit was exposed to light from the cover sheet side through a gray filter, and the processing composition was spread between the light-sensitive element and the cover sheet to a thickness of 75 μm at 25° C. by means of a pressure roll.

After 1 hour from the spreading, the maximum density $D_{max}$ (reflection density) of the transferred dye image was measured with FSD to compare the samples preserved at room temperature with those subjected to accelerated aging. As a result, film unit 303 underwent a serious reduction in yellow and magenta maximum density due to accelerated aging, and film unit 302 particularly showed an increase in magenta density. To the contrary, film unit 303 according to the present invention underwent little variation in maximum density, obviously proving the effectiveness of the incorporation of the tertiary amine polymer of the present invention into a processing composition on stabilization with time.

EXAMPLE 4

A processing composition having the following formulation, designated sample 401, was packed in a container destroyable by pressure by 0.8 g portions.

| Processing Composition Formulation: | |
|---|---|
| 1-p-Tolyl-4-hydroxymethyl-4-methyl-3-pyrazolidone | 10.0 g |
| Methylhydroquinone | 0.18 g |
| 5-Methylbenzotriazole | 3.0 g |
| Sodium sulfite | 0.2 g |
| Benzyl alcohol | 1.5 cc |
| Sodium carboxymethyl cellulose | 58 g |
| Carbon black | 150 g |
| Potassium hydroxide (28% aqueous solution) | 200 cc |
| Water | 680 cc |

Alkali processing compositions (designated 402 to 413) were prepared in the same manner as for processing composition 401, except that the formulation further contained the polymer shown in Table 6 in an amount corresponding to 7 mmol/m$^2$ in terms of amine site when spread on the light-sensitive in the manner hereinafter described.

Each of the processing compositions 401 to 413 was combined with light-sensitive element K-1 prepared in Example 3 and cover sheet C-1 prepared in Example 3 to obtain film units 401 to 413.

Light-sensitive element K-1 was exposed to light from its emulsion layer side, and cover sheet C-1 was superposed thereon. Each processing composition was spread therebetween to a thickness of 75 μm by means of a pressure roll at 25° C.

After 1 hour from the spreading, the maximum density (reflection density) of the transferred dye image was measured with FSD. Then, the film unit was preserved at 40° C. and 70% RH for 4 days, and the maximum density was again measured. The results obtained are shown in Table 6.

TABLE 6

| Film Unit No. | Polymer | Initial Maximum Density B | G | R | Maximum Density After 4 Dys (40° C., 70%) B | G | R | Remarks |
|---|---|---|---|---|---|---|---|---|
| 401 | — | 1.80 | 2.15 | 2.30 | 1.99 | 2.46 | 2.55 | Comparison |
| 402 | R-1* | 0.78 | 0.91 | 1.45 | 0.88 | 1.07 | 1.52 | " |
| 403 | R-2** | 0.72 | 0.85 | 1.39 | 0.81 | 1.00 | 1.47 | " |
| 404 | (1) | 1.78 | 2.13 | 2.31 | 1.91 | 2.38 | 2.49 | Invention |
| 405 | (6) | 1.78 | 2.14 | 2.29 | 1.89 | 2.34 | 2.48 | " |
| 406 | (9) | 1.79 | 2.14 | 2.28 | 1.89 | 2.32 | 2.46 | " |
| 407 | (18) | 1.78 | 2.12 | 2.31 | 1.83 | 2.25 | 2.45 | " |
| 408 | (20) | 1.79 | 2.15 | 2.32 | 1.82 | 2.24 | 2.41 | " |
| 409 | (23) | 1.78 | 2.15 | 2.32 | 1.81 | 2.26 | 2.43 | " |
| 410 | (24) | 1.80 | 2.13 | 2.26 | 1.84 | 2.25 | 2.39 | " |
| 411 | (25) | 1.76 | 2.10 | 2.29 | 1.79 | 2.20 | 2.41 | " |
| 412 | (26) | 1.74 | 2.09 | 2.29 | 1.78 | 2.21 | 2.43 | " |
| 413 | (27) | 1.76 | 2.09 | 2.27 | 1.78 | 2.17 | 2.35 | " |

Note:
*: Compound of the following formula, described in British Patent 1537079:

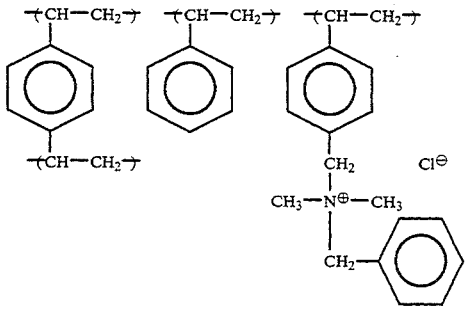

**: The polymer mordant used in layer (1) of light-sensitive element K-1.

Comparative film unit 401 suffered from a serious increase in density, especially magenta density, with time. The quaternary ammonium salt polymers used in processing compositions 402 and 403 caused a noticeable reduction in density after processing. To the contrary, the tertiary amine polymer according to the present invention caused little reduction in density and also suppressed an increase in density, particularly magenta density, with time. Incidentally, experiments were similarly performed by using secondary amine compounds, but the compounds exhibited no effect on suppression of density increase with time (not shown in Table 6). These results apparently prove the effects of the tertiary amine polymer of the present invention. It is also seen that the latex polymers used in film units 407 to 413 are more advantageous than the compounds used in film units 404 to 406 for suppression of density increase.

Further, light-sensitive element K-1 was exposed to light of square wave to evaluate image sharpness. The minimum density of a magenta dye image (4 lines/mm) was measured after 1 hour from the spreading of the processing composition and after preserving at 60° C. and 70% RH for 3 days to obtain an increase. As a result, the film unit 401 underwent a magenta density increase of 0.06 and smearing of the magenta image, while film units 407 to 413 had a smear-free clear image showing a density increase of not more than 0.02 with time.

EXAMPLE 5

1) Preparation of Light-Sensitive Element:

A light-sensitive sheet was prepared by coating a polyethylene terephthalate transparent support with the following layers.

Backing Layer:

A light-shielding layer consisting of 4.0 g/m$^2$ of carbon black and 2.0 g/m$^2$ of gelatin.

Emulsion Layers:

(1) A layer containing 0.44 g/m$^2$ of a cyan dye-releasing redox compound of formula:

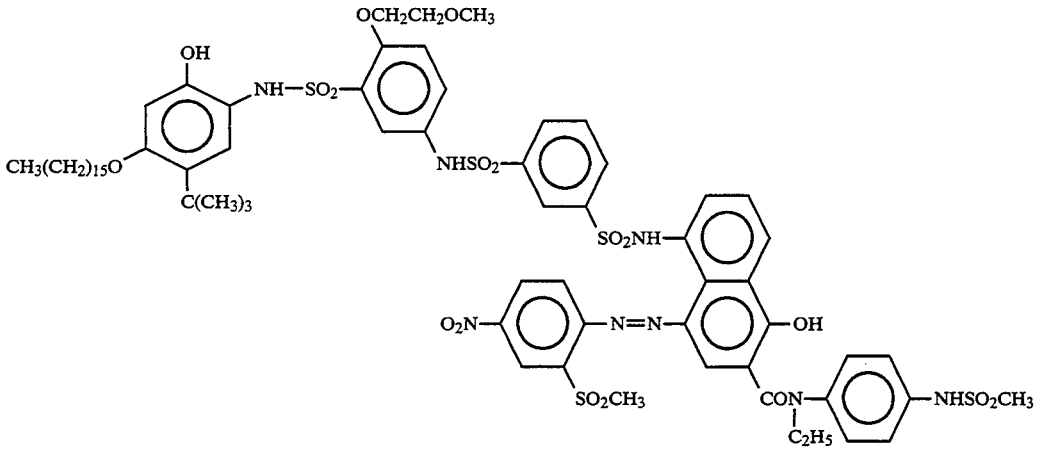

0.09 g/m$^2$ of tricyclohexyl phosphate, 0.008 g/m$^2$ of 2,5-di-t-pentadecylhydroquinone, and 0.8 g/m$^2$ of gelatin.

(2) A layer containing 0.5 g/m$^2$ of gelatin.

(3) A red-sensitive emulsion layer containing 0.6 g-Ag/m$^2$ of a red-sensitive internal latent image type direct positive silver bromide emulsion, 1.2 g/m$^2$ of gelatin, 0.015 g/m$^2$ of a nucleating agent of formula:

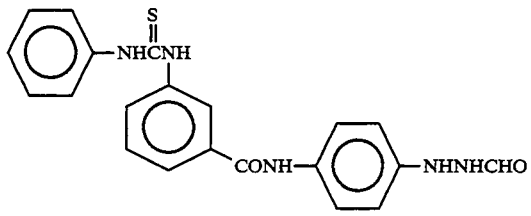

and 0.06 g/m$^2$ of sodium 2-sulfo-5-n-pentadecylhydroquinone.

(4) A layer containing 0.43 g/m$^2$ of 2,5-di-t-pentadecylhydroquinone, 0.1 g/m$^2$ of trihexyl phosphate, and 0.4 g/m$^2$ of gelatin.

(5) A layer containing 0.3 g/m$^2$ of a magenta dye-releasing redox compound of formula:

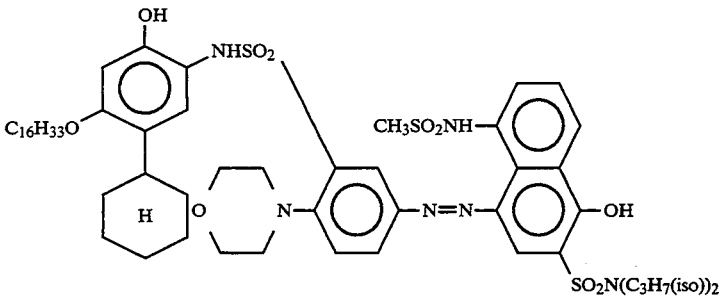

0.08 g/m$^2$ of tricyclohexyl phosphate, 0.009 g/m$^2$ of 2,5-di-t-pentadecylhydroquinone, and 0.5 g/m$^2$ of gelatin.

(6) A green-sensitive emulsion layer containing 0.42 g-Ag/m$^2$ of a green-sensitive internal latent image type direct positive silver bromide emulsion, 0.9 g/m$^2$ of gelatin, 0.013 g/m$^2$ of the same nucleating agent as used in layer (3), and 0.07 g/m$^2$ of sodium 2-sulfo-5-n-pentadecylhydroquinone.

(7) The same layer as layer (4).

(8) A layer containing 0.53 g/m$^2$ of a yellow dye-releasing redox compound of formula:

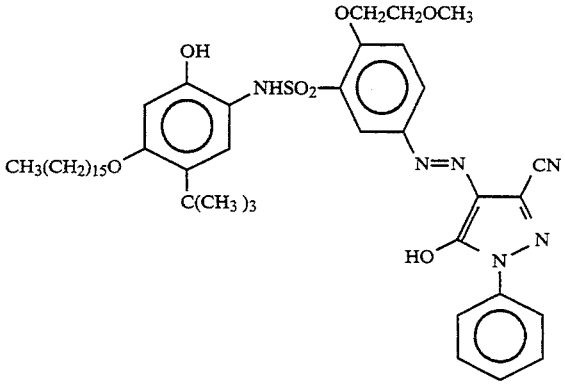

0.13 g/m² of tricyclohexyl phosphate, 0.014 g/m² of 2,5-di-t-pentadecylhydroquinone, and 0.7 g/m² of gelatin.

(9) A blue-sensitive emulsion layer containing 0.6 g-Ag/m² of a blue-sensitive internal latent image type direct positive silver bromide emulsion, 1.1 g/m² of gelatin, 0.019 g/m² of the same nucleating agent as used in layer (3), and 0.05 g/m² of sodium 2-sulfo-5-n-pentadecylhydroquinone.

(10) A layer containing 1 g/m² of gelatin.

2) Preparation of Image-Receiving Sheet (dye fixing element):

An image-receiving sheet having the layer structure shown in Table 7 was prepared.

TABLE 7

| Layer No. | Layer Function | Component | Coating Weight (g/m²) |
|---|---|---|---|
| F6 | Protective layer | Gelatin | 0.6 |
| F5 | Mordanting layer | Gelatin | 3.0 |
| | | Mordant (A) | 3.0 |
| | | Coating aid (B) | 0.5 |
| F4 | Timing layer (1) | Polymer latex (1) | 0.96 |
| | | Polymer latex (2) | 0.64 |
| F3 | Intermediate layer | Poly(2-hydroxyethyl methacrylate) | 0.4 |
| F2 | Timing layer (2) | Cellulose acetate (degree of acetylation: 51.3%) | 4.27 |
| | | Styrene/maleic anhydride (1:1 by mole) copolymer (average molecular weight: 10,000) | 0.23 |
| F1 | Neutralizing layer | Acrylic acid/butyl acrylate (8:2 by mole) copolymer (average molecular weight: 50,000) | 22 |
| Support | | Paper having a 30 μm thick polyethylene layer on each side (total thickness: 150 μm) | |
| B1 | Light-shielding layer | Gelatin | 2.0 |
| | | Carbon black | 4.0 |
| B2 | White reflecting layer | Gelatin | 1.0 |
| | | Titanium oxide | 8.0 |
| B3 | Protective layer | Gelatin | 0.6 |

Mordant (A):

TABLE 7-continued

| Layer No. | Layer Function | Component | Coating Weight (g/m²) |
|---|---|---|---|

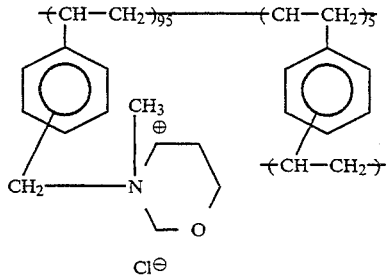

Coating Aid (B):

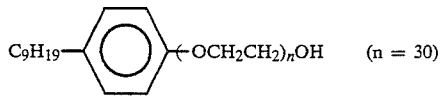

Polymer latex (1):
Styrene/butyl acrylate/acrylic acid/N-methylolacrylamide (49.7/42.3/4/4 by weight ) copolymer
Polymer latex (2):
Methyl methacrylate/acrylic acid/N-methylolacrylamide (93/3/4 by weight) copolymer 3) Processing Solution:

A processing composition having the following formulation was prepared (designated processing composition 501).

| Processing Composition Formulation: | |
|---|---|
| 1-p-Tolyl-4-hydroxymethyl-4-methyl-3-pyrazolidone | 6.9 g |
| Methylhydroquinone | 0.3 g |
| 5-Methylbenzotriazole | 3.5 g |
| Sodium sulfite (anhydrous) | 0.2 g |
| Sodium carboxymethyl cellulose | 58 g |
| Potassium hydroxide (28% aqueous solution) | 200 cc |
| Benzyl alcohol | 1.5 cc |
| Water | 835 cc |

Processing compositions 502 to 506 were prepared in the same manner as for processing composition 501, except that the composition further contained 3 mmol/m², in terms of amine site when spread in a film unit, of the tertiary amine polymer shown in Table 8.

4) Development and Evaluation:

The above prepared light-sensitive sheet and the image-receiving sheet were combined with each of processing compositions 501 to 506 to prepare film units 501 to 506.

The light-sensitive sheet was imagewise exposed to light, and the image-receiving sheet was brought into contact therewith. Each processing composition was spread therebetween to a thickness of 60 μm at 25° C. by means of a pressure roll. After 90 seconds' or 180 seconds' contact, the image-receiving sheet was peeled apart, and the maximum density ($D_{max}$) was measured. The results obtained are shown in Table 8.

TABLE 8

| Film Unit | | Maximum Density | | | | | | |
|---|---|---|---|---|---|---|---|---|
| | | Processing Time: 90 sec | | | Processing Time: 180 sec | | | |
| No. | Polymer | B | G | R | B | G | R | Remarks |
| 501 | — | 1.80 | 2.20 | 2.70 | 2.11 | 2.41 | 2.89 | Compari- |

TABLE 8-continued

| Film Unit No. | Polymer | Maximum Density: Processing Time: 90 sec B | G | R | Processing Time: 180 sec B | G | R | Remarks |
|---|---|---|---|---|---|---|---|---|
| | | | | | | | | son |
| 502 | V-20 | 1.80 | 2.17 | 2.68 | 1.93 | 2.31 | 2.81 | Invention |
| 503 | V-25 | 1.79 | 2.16 | 2.69 | 1.91 | 2.29 | 2.82 | " |
| 504 | V-14 | 1.79 | 2.18 | 2.70 | 1.90 | 2.29 | 2.81 | " |
| 505 | V-15 | 1.79 | 2.18 | 2.69 | 1.90 | 2.28 | 2.80 | " |
| 506 | V-27 | 1.80 | 2.17 | 2.69 | 1.89 | 2.26 | 2.78 | " |

The results in Table prove that the tertiary amine polymer according to the present invention is effective in suppressing an increase in density after processing when applied to the peel-apart type system of this example.

As described and demonstrated above, the film unit of the present invention provides a transferred image, especially a color transferred image, having a high density with reduced dependency on processing time, and suppresses changes in density of the resulting image with time after processing.

While the invention has been described in detail and with reference to specific examples thereof, it will be apparent to one skilled in the art that various changes and modifications can be made therein without departing from the spirit and scope thereof.

What is claimed is:

1. A color diffusion transfer film unit consisting of (1) a light-sensitive sheet comprising a transparent support having thereon an image-receiving layer, a white reflecting layer, a light-shielding layer, and at least one silver halide emulsion layer combined with at least one dye image-forming compound, (2) a transparent cover sheet comprising a transparent support having thereon at least a neutralizing layer and a neutralization timing layer, and (3) a light-shielding alkali processing composition which is to be spread between light-sensitive sheet (1) and cover sheet (2), in which said alkali processing composition contains a tertiary amine polymer.

2. A color diffusion transfer film unit consisting of (1) an image-receiving sheet comprising a support having thereon a neutralizing layer, a neutralization timing layer, an image-receiving layer, and a release layer in this order, (2) a light-sensitive sheet comprising a light-shielding support having thereon at least one silver halide emulsion layer combined with at least one dye image-forming compound, and (3) an alkali processing composition which is to be spread between image-receiving sheet (1) and light-sensitive sheet (2), in which said alkali processing composition contains a tertiary amine polymer.

3. An image formation method for a color diffusion transfer process which comprises the steps of:

(a) providing a peel-apart type or monosheet type color diffusion transfer film unit comprising at least one light sensitive silver halide emulsion layer combined with at least one dye image forming compound and at least one image receiving layer and containing an alkali processing composition containing a tertiary amine polymer;

(b) imagewise exposing the color diffusion transfer film unit to light; and (c) developing and transferring the image to the image receiving layer using said alkali processing composition, wherein the tertiary amine polymer functions to suppress undesirable dye transfer to the image receiving layer from the light sensitive silver halide emulsion layer.

4. A color diffusion transfer film unit as claimed in claim 1, wherein said tertiary amine polymer comprises a repeating unit represented by formula (III):

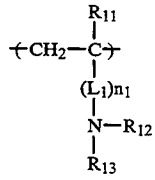

(III)

wherein $R_{11}$ represents a hydrogen atom or an alkyl group having 1 to 4 carbon atoms; $R_{12}$ and $R_{13}$ each independently represent an alkyl group having 1 to 20 carbon atoms, an aralkyl group, an alkenyl group or an alkynyl group; $L_1$ represents a divalent linking group having 1 to 24 carbon atoms; $R_{12}$, $R_{13}$, and $L_1$ may be taken together to form a nitrogen-containing 3- to 8-membered ring; and $n_1$ represents 0 or 1.

5. A color diffusion transfer film unit as claimed in claim 2, wherein said tertiary amine polymer comprises a repeating unit represented by formula (III):

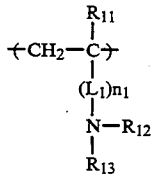

(III)

wherein $R_{11}$ represents a hydrogen atom or an alkyl group having 1 to 4 carbon atoms; $R_{12}$ and $R_{13}$ each independently represent an alkyl group having 1 to 20 carbon atoms, an aralkyl group, an alkenyl group or an alkynyl group; $L_1$ represents a divalent linking group having 1 to 24 carbon atoms; $R_{12}$, $R_{13}$, and $L_1$ may be taken together to form a nitrogen-containing 3- to 8-membered ring; and $n_1$ represents 0 or 1.

6. A color diffusion transfer film unit as claimed in claim 1, wherein said tertiary amine polymer is a latex polymer comprising a repeating unit represented by formula (III):

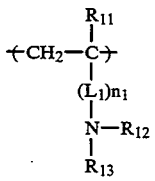

(III)

wherein $R_{11}$ represents a hydrogen atom or an alkyl group having 1 to 4 carbon atoms; $R_{12}$ and $R_{13}$ each independently represent an alkyl group having 1 to 20 carbon atoms, an aralkyl group, an alkenyl group or an alkynyl group; $L_1$ represents a divalent linking group having 1 to 24 carbon atoms; $R_{12}$, $R_{13}$, and $L_1$ may be taken together to form a nitrogen-containing 3- to 8-membered ring; and n1 represents 0 or 1, and a repeating unit represented by formula (IV):

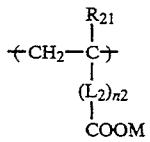

(IV)

wherein $R_{21}$ represents a hydrogen atom or an alkyl group; $L_2$ represents a divalent linking group; n2 represents 0 or 1; and M represents a hydrogen atom or an alkali metal atom.

7. A color diffusion transfer film unit as claimed in claim 2, wherein said tertiary amine polymer is a latex polymer comprising a repeating unit represented by formula (III):

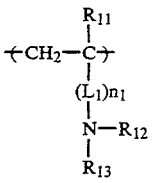

(III)

wherein $R_{11}$ represents a hydrogen atom or an alkyl group having to 4 carbon atoms; $R_{12}$ and $R_{13}$ each independently represent an alkyl group having 1 to 20 carbon atoms, an aralkyl group, an alkenyl group or an alkynyl group; $L_1$ represents a divalent linking group having 1 to 24 carbon atoms; $R_{12}$, $R_{13}$, and $L_1$ may be taken together to form a nitrogen-containing 3- to 8-membered ring; and $n_1$ represents 0 or 1, and a repeating unit represented by formula (IV):

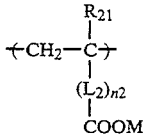

(IV)

wherein $R_{21}$ represents a hydrogen atom or an alkyl group; $L_2$ represents a divalent linking group; $n_2$ represents 0 or 1; and M represents a hydrogen atom or an alkali metal atom.

8. A color diffusion transfer film unit as claimed in claim 4, wherein Lx in formula (III) is a divalent linking group containing a benzene ring and having 7 to 10 carbon atoms in total.

9. A color diffusion transfer film unit as claimed in claim 5, wherein $L_1$ in formula (III) is a divalent linking group containing a benzene ring and having 7 to 10 carbon atoms in total.

10. A color diffusion transfer film unit as claimed in claim 6, wherein $L_1$ in formula (III) is a divalent linking group containing a benzene ring and having 7 to 10 carbon atoms in total.

11. A color diffusion transfer film unit as claimed in claim 7, wherein $L_1$ in formula (III) is a divalent linking group containing a benzene ring and having 7 to 10 carbon atoms in total.

* * * * *